US005994685A

United States Patent [19]

Jackson et al.

[11] Patent Number: 5,994,685

[45] **Date of Patent: *Nov. 30, 1999**

[54] TREATMENTS FOR MICROWAVE POPCORN PACKAGING AND PRODUCTS

[75] Inventors: Eric Craig Jackson, Maple Grove; Denise Ellen Hanson, Elk River, both of Minn.

[73] Assignee: Golden Valley Microwave Foods, Inc., Edina, Minn.

[ * ] Notice: This patent is subject to a terminal disclaimer.

[21] Appl. No.: 08/972,906

[22] Filed: Nov. 18, 1997

Related U.S. Application Data

[63] Continuation of application No. 08/534,831, Sep. 27, 1995, Pat. No. 5,690,853.

[51] Int. Cl.[6] ..... H05B 6/80

[52] U.S. Cl. ..... 219/727; 219/730; 426/234; 383/113

[58] Field of Search ..... 219/727, 730, 219/725; 426/107, 109, 113, 115, 234, 243; 383/113, 120, 109, 112, 116; 229/3.1, 903; 99/DIG. 14

[56] References Cited

U.S. PATENT DOCUMENTS

| | | | |
|---|---|---|---|
| 2,041,227 | 5/1936 | Chalmers . | |
| 2,149,872 | 3/1939 | Schmidt . | |
| 2,628,764 | 2/1953 | Rubinstein et al. . | |
| 2,741,559 | 4/1956 | Banowitz . | |
| 3,008,835 | 11/1961 | Madding . | |
| 3,027,261 | 3/1962 | Samara . | |
| 3,035,754 | 5/1962 | Meister . | |
| 3,036,616 | 5/1962 | Allen . | |
| 3,052,554 | 9/1962 | Colman . | |
| 3,207,420 | 9/1965 | Navarrete-Kindelan . | |
| 3,286,832 | 11/1966 | Pilger . | |
| 3,293,048 | 12/1966 | Kitterman . | |
| 3,317,118 | 5/1967 | Harrison et al. . | |
| 3,637,132 | 1/1972 | Gray . | |
| 3,661,697 | 5/1972 | Kimmel et al. | 161/250 |
| 3,671,270 | 6/1972 | Jehn . | |
| 3,689,291 | 9/1972 | Draper . | |
| 3,835,280 | 9/1974 | Gades et al. . | |
| 3,839,144 | 10/1974 | Louden | 162/141 |
| 3,851,574 | 12/1974 | Katz et al. . | |
| 3,853,612 | 12/1974 | Spanoudis . | |
| 3,873,735 | 3/1975 | Chalin et al. . | |
| 3,938,659 | 2/1976 | Wardwell | 206/439 |
| 3,946,780 | 3/1976 | Sellers | 426/118 |
| 3,970,241 | 7/1976 | Hanson . | |
| 3,973,045 | 8/1976 | Brandberg et al. . | |
| 4,038,425 | 7/1977 | Brandberg et al. . | |
| 4,190,757 | 2/1980 | Turpin et al. . | |

(List continued on next page.)

FOREIGN PATENT DOCUMENTS

| | | |
|---|---|---|
| 449465 | 6/1948 | Canada . |
| 692877 | 8/1964 | Canada . |
| 1069861 | 1/1980 | Canada . |
| 81544 | 7/1956 | Denmark . |
| 0 276 654 | 1/1988 | European Pat. Off. . |
| 0 357 008 | 8/1988 | European Pat. Off. . |
| 0 312 333 | 10/1988 | European Pat. Off. . |
| 1786047 | 11/1971 | Germany . |
| 2 202 118 | 9/1988 | United Kingdom . |
| PCT/US93/00849 | 8/1993 | WIPO . |

*Primary Examiner*—Philip H. Leung
*Attorney, Agent, or Firm*—Merchant & Gould P.C.

[57] ABSTRACT

In one form of the invention, a microwave popcorn package is provided. The package generally comprises a sheet construction of flexible paper folded in the form of an expandable bag. The sheet construction may include one or more plies of material. In preferred applications, the package includes an inner ply of paper to which has been applied an adhesive, to provide improvement in greaseproofness. In some preferred arrangements, the package includes inner and outer plies, and the outer ply also includes an adhesive applied to it, to provide grease-resistant character. A preferred method for preparing arrangements according the present invention is provided.

10 Claims, 6 Drawing Sheets

U.S. PATENT DOCUMENTS

| | | | |
|---|---|---|---|
| 4,219,573 | 8/1980 | Borek . | |
| 4,230,924 | 10/1980 | Brastad et al. . | |
| 4,267,420 | 5/1981 | Brastad . | |
| 4,292,332 | 9/1981 | McHam . | |
| 4,404,241 | 9/1983 | Mueller . | |
| 4,450,180 | 5/1984 | Watkins . | |
| 4,461,031 | 7/1984 | Blamer . | |
| 4,518,651 | 5/1985 | Wolfe, Jr. . | |
| 4,548,826 | 10/1985 | Watkins . | |
| 4,553,010 | 11/1985 | Bohrer et al. . | |
| 4,571,337 | 2/1986 | Cage et al. . | |
| 4,584,202 | 4/1986 | Roccaforte . | |
| 4,604,854 | 8/1986 | Andreas . | |
| 4,641,005 | 2/1987 | Seiferth . | |
| 4,678,882 | 7/1987 | Bohrer et al. . | |
| 4,691,374 | 9/1987 | Watkins et al. . | |
| 4,698,472 | 10/1987 | Cox et al. . | |
| 4,735,513 | 4/1988 | Watkins et al. . | |
| 4,825,024 | 4/1989 | Seaborne . | |
| 4,851,246 | 7/1989 | Maxwell et al. . | |
| 4,864,090 | 9/1989 | Maxwell et al. . | |
| 4,878,765 | 11/1989 | Watkins et al. . | |
| 4,904,488 | 2/1990 | LaBaw et al. . | |
| 4,943,456 | 7/1990 | Pollart et al. . | |
| 4,970,358 | 11/1990 | Brandberg et al. . | |
| 4,973,810 | 11/1990 | Brauner . | |
| 4,982,064 | 1/1991 | Hartman et al. . | |
| 5,006,405 | 4/1991 | Watkins et al. . | |
| 5,011,299 | 4/1991 | Black, Jr. et al. . | |
| 5,044,777 | 9/1991 | Watkins et al. | 219/730 |
| 5,079,083 | 1/1992 | Watkins et al. . | |
| 5,081,330 | 1/1992 | Brandberg et al. . | |
| 5,175,031 | 12/1992 | Ochocki . | |
| 5,189,272 | 2/1993 | McDonald et al. | 219/727 |
| 5,195,829 | 3/1993 | Watkins et al. . | |
| 5,200,590 | 4/1993 | Bowen et al. . | |
| 5,294,765 | 3/1994 | Archibald et al. . | |
| 5,302,790 | 4/1994 | Turpin . | |
| 5,306,512 | 4/1994 | Blamer . | |
| 5,344,661 | 9/1994 | Mendenhall et al. . | |
| 5,357,086 | 10/1994 | Turpin et al. . | |
| 5,405,663 | 4/1995 | Archibald et al. . | |
| 5,461,216 | 10/1995 | McDonald . | |
| 5,690,853 | 11/1997 | Jackson et al. | 219/727 |

TREATMENTS FOR MICROWAVE POPCORN PACKAGING AND PRODUCTS

The present application is a continuation application of U.S. Ser. No. 08/534,831, filed Sep. 27, 1995, now U.S. Pat. No. 5,690,853, which patent is incorporated herein by reference.

FIELD OF THE INVENTION

The present invention relates to materials and packaging for containment of grease-containing materials. Certain preferred applications described herein relate to microwaveable food preparations which are stored and cooked within the same packaging. In some applications, the invention concerns expandable bag arrangements used for popping microwave popcorn.

BACKGROUND OF THE INVENTION

Many microwave popcorn popping constructions in common commercial use are multi-ply paper bags in which inner and outer paper sheets are laminated to one another, with a microwave interactive construction (sometimes referred to as a microwave susceptor) encapsulated between the paper plies. Popcorn popping bags of this type are described, for example, in U.S. Pat. Nos. 4,904,488; 4,973,810; 4,982,064; 5,044,777; and 5,081,330, the disclosures of which are incorporated herein by reference.

A common feature of such constructions is that they are generally made from flexible paper materials. In this manner, the constructions are sufficiently flexible to open or expand conveniently under steam pressure, when a popcorn charge therein is exposed to microwave energy in a microwave oven. Also the materials are sufficiently flexible to be formed from a sheet into a folded configuration, for example during a continuous bag-construction process.

Many microwave popcorn products include, within the bag, a charge of unpopped popcorn kernels, fat/oil (i.e. grease) and flavor (for example salt). The fat/oil is typically in a form which is not liquefied until at least about 105° F. However, during storage or shipment, especially if the environment becomes relatively hot, the material stored within the bag can become liquefied and leak through the bag construction. Even when relatively high temperatures are not encountered in storage, some leakage can occur if the stored material includes a significant amount of flowable or liquefied oil/fat.

In addition, conventional microwave cooking of popcorn (especially when the popcorn charge includes fat/oil) results in the generation of hot liquid oil or fat. If the construction retaining the popcorn charge is paper, the paper must be sufficiently resistant to staining and to the passage of hot liquid oil/fat therethrough, during the microwave cooking process, to be satisfactory for performance of the product. For example, the oil/fat should not leak from the construction, when the microwave cooking (i.e. popping) is undertaken, sufficiently to generate an undesirable greasy feel or appearance, to the outside of the package.

Greaseproof papers have been developed for utilization in constructions which must, to some extent, resist the passage of oil-like liquids, such as hot liquid oil/fat, therethrough. In general, during construction of a greaseproof paper, the pulp is abraded so that when the greaseproof treatment is cast on it, substantial hydrogen bonding in the cellulose occurs. This process of abrading the pulp is generally referred to as "refining". Typically the more refined the paper is, the more brittle it is. Thus, if a heavy, strongly greaseproof, paper is utilized, a relatively rigid, brittle (nonflexible) construction results.

A general trend, then, is that while a paper system can be made readily greaseproof by abrading, for retaining of oil therein, such a construction will generally be brittle and not of desirable flexibility or strength for ease of assembly, folding, filling, storage and/or use. Also, should a crease or sharp fold (i.e. discontinuity) develop in such material, a leak can readily occur along that resulting discontinuity.

In order to provide some flexibility in the greaseproof paper, modern greaseproof papers involve some refinement of the pulp and some chemical treatment. With less refinement, the resulting paper is less brittle. However, in general such greaseproof papers have not been found to be fully desirable, by themselves, as the construction material for microwave cooking constructions.

A typical, conventional approach to this is for an arrangement of flexible paper in microwaveable systems to have a multi-ply construction, with at least one layer of greaseproof paper bonded to a layer of kraft paper. As a result of such a composite or multi-ply construction, a paper construction material can be readily provided which is both flexible and greaseproof.

While such constructions have been provided for microwave constructions, especially those for retaining microwave popcorn, continued improvement is sought. For example, chemical treatments for rendering refined papers greaseproof and/or grease-resistant typically involve fluorochemicals. In some applications, it would be preferred, if possible, to avoid or reduce fluorochemical use, or papers which have been treated with substantial amounts of fluorochemicals.

Further, the laminating adhesives used in the multi-ply arrangements often include polyvinyl acetates. A typical one is Duracet 12, available from Franklin International of Columbus, Ohio 43207. In some applications, it would be preferred, if possible, to reduce the utilization of such adhesives.

SUMMARY OF THE INVENTION

A variety of constructions and techniques are provided according to the present disclosure. They generally concern the preparation of preferred flexible constructions. Some of them may be summarized as follows.

In each of the arrangements described, the first adhesive may be a starch-based adhesive. It may also be an alternative resin, for example certain synthetic resins.

A. A First Characterization

According to one aspect of principles described herein, a microwave popcorn package is provided. The microwave popcorn package comprises a flexible bag construction comprising inner and outer plies of paper; and, the bag construction contains a charge of popcorn and oil/fat positioned therein. The inner ply is preferably a non-greaseproof paper. In some typical preferred systems, the construction includes a weight ratio of unpopped popcorn to oil/fat within the range of 2:1 to 20:1. The construction may also include flavorant, for example salt.

It is unusual that a greaseproof bag construction can be formed without the use of greaseproof paper for the inner ply. According to the present invention this characteristic is provided by using a preferred adhesive as a laminating adhesive between the inner and outer plies.

Herein when it is said that a ply is "non-greaseproof", it is meant that the material from which the ply is formed, if tested according to the turpentine test described herein, would show a greaseproofness of less than 3 hours, typically less than 2 hours and often less than one hour. Herein when it is said that the bag construction is greaseproof, it is meant that the construction does not substantially or unacceptably leak oil or grease therefrom, when stored with a charge of popcorn and oil/fat therein, for extended periods of time, especially at elevated temperatures. As an alternate method of definition, if a test laminate involving the same materials (used for the inner and outer plies and the laminated adhesive) were subjected to the turpentine test described herein, the laminate would show a greaseproofness of at least 2 hours, typically at least 3 hours and preferably at least 24 hours.

Herein when it is said that an adhesive or coating is one which improves greaseproofness, it is meant that if the untreated paper is one which has a first level of greaseproofness, after the adhesive or coating is applied the resulting composite material is one which has a second, higher, level of greaseproofness.

In certain applications of the present invention, the inner ply of the arrangement described in this section may even comprise a non-fluorochemically treated kraft paper. Indeed, the inner ply may even be formed from a paper material which is so porous that a value of 500 Gurley seconds or less is obtained by porosity testing as described. Further, it may even comprise a paper having a pin hole porosity of at least $1/inch^2$ up to $250–300/inch^2$. Thus, in some applications of the present invention, a relatively inexpensive, porous, non-fluorochemically treated, non-greaseproof kraft paper can be effectively used as an inner layer in place of highly refined, low porosity, greaseproof paper, in packaging such as microwave packaging. This can be advantageous for, among other reasons, cost savings and process advantages.

In some applications of the present invention, the outer ply can be formed from a non-fluorochemically treated, machine glazed, paper and yet the outer surface of the construction will be grease resistant. Preferably, in such applications the outer ply has an outer surface to which is applied an adhesive material in sufficient amount to provide the outer ply with an increased grease resistance, relative to its absence. By this, it is meant that the outer ply can be a paper which, if a sample of it were tested as described below, would have a first level of grease resistance; and, when a coating as described herein is applied to the paper, the resulting sample has a higher level of grease resistance. A preferred method of evaluation for grease resistance described and reported herein comprises the Scotchban® test.

Herein when it is said that the outer surface of a bag construction is "grease-resistant", it is generally meant that it has a characteristic of resistance to staining, when grease appears thereon. In an alternate method and definition, grease resistance can be determined using the Scotchban® test described herein. In general, the Scotchban® grease resistance kit level that defines an acceptable level of grease resistance will vary from industry to industry. With respect to materials for microwave popcorn packaging, a material will be considered "grease resistant" if, under the Scotchban® test, it shows a grease resistance of minimum kit 8. According to certain applications of the present invention, the outer layer of a multi-ply microwave bag construction may be formed from a paper having a grease resistance of less than kit 8, yet have the overall bag construction possess an outer surface with a grease resistance of minimum kit 8 by coating the cuter surface with a preferred material as defined herein.

For comparison, in materials for enclosing french fry food products, grease resistance is generally associated with a grease resistance of minimum kit 4. The principles of the present invention can be applied in a variety of industries, and with a variety of grease resistance specifications.

Arrangements as described herein may preferably include a microwave interactive construction positioned between the inner and outer plies of paper. In preferred arrangements, the microwave interactive construction comprises metallized polymeric film, typically including the metal deposit on only one side of the film. In certain preferred arrangements, the microwave interactive construction is oriented in the package with the metal film directed toward the inner ply and with an adhesive between the metal film and the inner ply.

B. A Second Characterization

In another manner of defining certain advances described herein, a microwave popcorn package is provided which comprises a sheet construction of flexible paper folded in the form of an expandable bag, the sheet construction comprising inner and outer plies of paper. The inner ply may or may not be a greaseproof paper, and preferably has an inner surface and an outer surface. A first adhesive is applied on at least a portion of the outer surface of the inner ply of the paper. The first adhesive is preferably in an amount sufficient, and has greaseproof properties in combination with the inner ply of paper sufficient, to provide a portion of the inner ply of paper to which it is applied with improved greaseproofness.

The first adhesive is preferably a material which, when applied in test lamination as a laminating adhesive between two plies of non-greaseproof paper, provides the test lamination with a greaseproofness as measured by the turpentine test of at least 2 hours, more preferably at least 3 hours, and most preferably at least 24 hours. A particular, preferred, test lamination for identifying and evaluating the adhesive is provided in the Examples.

In this context and manner of defining certain arrangements according to the present invention, it is not meant that the adhesive, in the claimed construction, is necessarily laminated between two plies of non-fluorochemically treated kraft paper as defined. Rather, it is meant that the adhesive is one which, if it is tested in such a lamination, as described herein, would provide the greaseproofness described. In general, such adhesives will perform well in microwave popcorn packaging, as described by the claims. Certain preferred such adhesives are identified herein below.

In certain preferred applications of this particular defined approach, the first adhesive is preferably a material which, when applied in a second test lamination as a laminating adhesive between materials corresponding to the inner and outer plies of the claimed construction, also provides this second test lamination with a greaseproofness, when measured by the turpentine test described herein, of at least 2 hours, preferably at least 3 hours and most preferably at least 24 hours.

In this manner of defining an adhesive material according to the present invention, again it is not-meant that a test of the actual package construction necessarily results in measurement of the claimed grease resistance. Rather, what is meant is that if samples of the same materials that are used for the inner and outer ply are laminated to one another in a test lamination utilizing the first adhesive, and according to processes described hereinbelow for testing, and then the test lamination is tested according to the turpentine test described, the asserted value of greaseproofness results.

In certain preferred constructions according to this aspect of the invention and analogously to the first characterization, a microwave interactive construction is positioned between at least a portion of the inner and outer plies of paper. The microwave interactive construction in preferred arrangements comprises a metallized polymeric film including a metal deposit on only one side of the polymeric film. In certain preferred arrangements, the microwave interactive construction is oriented in the package with the metal film directed toward the inner ply and with a second adhesive used to secure the metal film to the inner ply.

In certain preferred aspects of arrangements according to this characterization of the invention and analogously to the first characterization, the outer ply has an outer surface to which is applied an adhesive, to provide grease-resistant character.

C. A Third Characterization

Another alternate characterization of techniques provided herein is as follows. According to this definition of invention, a microwave popcorn package is provided which comprises a sheet construction of flexible paper folded in the form of an expandable bag, the sheet construction comprising inner and outer plies of paper, the inner ply of paper having an inner surface and an outer surface. The arrangement further includes a first adhesive on at least a portion of the outer surface of the inner ply of paper, the first adhesive being in an amount sufficient, and having grease-resistant properties in combination with the inner ply of paper sufficient, to provide a portion of the inner ply of paper to which it is applied with improved grease resistance. Resistance to staining on the outer surface of the inner ply can provide advantage, since staining on this surface in some constructions will be viewable from the outside of the package. The utilization of the adhesive material between the two plies, then, in this arrangement provides for an inner ply which will show staining less, on its outer surface, than some conventional arrangements.

In this definition of the present invention, the first adhesive is preferably a material which, when applied in a test lamination as a laminating adhesive between two plies of non-fluorochemically treated kraft paper, provides the test lamination with a grease resistance, when measured by the Scotchban® test, of at least kit 8. A specific method for evaluating this is provided in the Examples.

The first adhesive is also preferably a material which provides a measurement of at least kit 8, when tested in a test lamination of the materials actually used as the inner and outer plies in the microwave package construction. Again, in this context it is not necessarily meant that evaluation of the first adhesive is made by actually taking a sample from the microwave popcorn package. Rather, it is meant that if a test lamination is made utilizing the same paper as used in the inner and outer plies of the claimed arrangement, and it is tested according to the procedures herein, the recited value for grease resistance is obtained.

D. A Fourth Characterization

According to this definition, a microwave popcorn package is provided which comprises a sheet construction of flexible paper folded in the form of an expandable bag, the sheet comprising inner and outer plies of paper, the outer ply having an inner surface and an outer surface. The construction includes an adhesive coating on at least a portion of the outer surface of the outer ply of paper. The adhesive of the adhesive coating is preferably in an amount sufficient, and has grease-resistant properties in combination with the outer ply of paper sufficient, to provide a portion of the outer ply of paper to which it is applied with improved grease resistance. The adhesive of this coating is preferably a material which, when applied as a test coating on non-fluorochemically treated paper as described, provides the coated surface with a grease resistance, when measured by the Scotchban® test, of at least kit 8.

In the above characterization, it is not meant that the coating actually and necessarily provides for the kit level of grease resistance defined in the claimed package. Rather, the definition is with respect to the nature of the adhesive, if applied in a test system as defined, and the test system is evaluated for grease resistance.

However, in preferred embodiments, the adhesive is a material which, if applied in a coated test sample of the same paper material that is used for the outer ply in the claimed construction, will provide the surface to which it is applied in that test a grease resistance of minimum kit 8, when evaluated by the Scotchban® test. As with previous characterizations that involve the materials of the actual claimed construction, it is not meant that a sample from the claimed construction is necessarily tested, but rather the same paper as used in the claimed construction is coated and tested.

E. A Fifth Characterization

According to this characterization, a flexible wrap comprising a sheet construction of flexible paper is provided. The sheet construction comprises first and second plies of paper, with the first ply of paper having an inner surface and an outer surface. In this context, the inner surface of the first ply is the surface which engages a wrapped item, when the flexible wrap is used; and, the "outer" surface of the second ply is the side directed away from the wrapper item in use. In this manner of defining certain applications of the principles provided herein, a first adhesive between at least a portion of the two plies is a material which, when applied in a test lamination as a laminating adhesive between materials corresponding to the first and second plies, provides the test lamination with a greaseproofness, when measured by the turpentine test, of at least 2 hours, preferably at least 3 hours, and most preferably at least 24 hours.

Alternatively, the adhesive may be defined as comprising an adhesive which, when tested in a test lamination between two sheets of non-fluorochemically treated kraft paper, as defined, provides the test lamination with a greaseproofness, when measured by the turpentine test, of at least 2 hours, preferably at least 3 hours and most preferably at least 24 hours. Thus, as was the case with the previous defined embodiments, the present embodiment can be defined by characterizing the adhesive with respect to its operation in a test laminate involving the actual materials of the claimed construction or alternatively with respect to its operation in a test laminate of a defined material. Preferably it is material which provides greaseproofness of at least 3 hours and more preferably at least 24 hours, in both systems.

Constructions according to this characterization may comprise a flexible wrap to be placed around a variety of foods, for example foods to be heated in a microwave oven, and need not necessarily be in the preformed construction of a bag or involve microwave popcorn. Such arrangements may optionally include therein microwave interactive material.

BRIEF DESCRIPTION OF THE DRAWINGS

FIG. 2 being taken generally along line 2—2, FIG. 1.

DETAILED DESCRIPTION OF THE INVENTION

Figure 1:
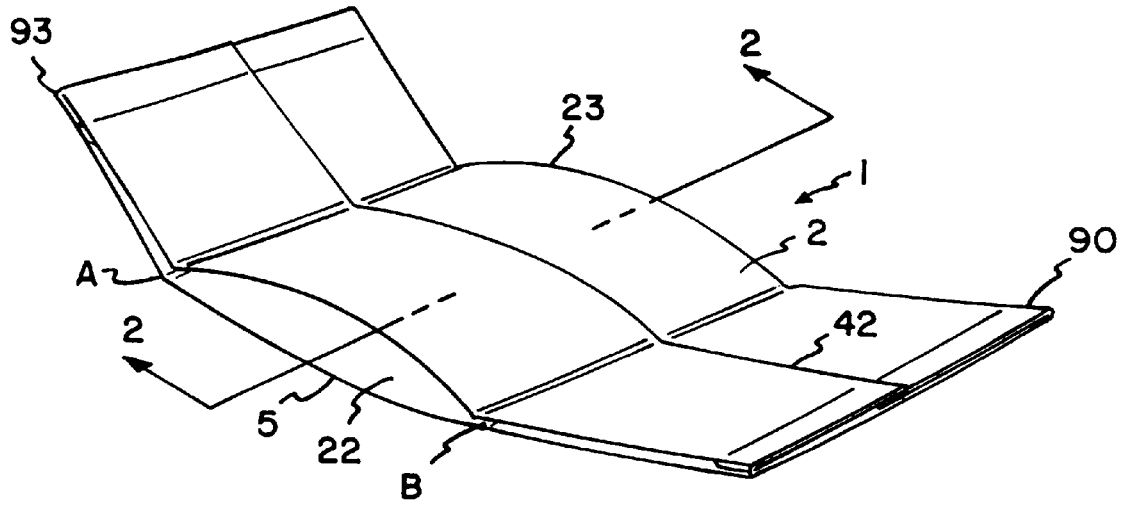
FIG. 1 is a perspective view of a microwave bag construction, according to the present invention, depicted unfolded and prior to expansion, in use.

I. Certain Specific Disadvantages in Prior Systems

A. Undesirable Volatile Organic Compounds in the Various Adhesives Used

As indicated above, many microwave popcorn bags, in typical commercial use, are constructed of a laminated system including printed, bleached, kraft paper on the outside, a thin film of metallized susceptor in the middle, and a greaseproof paper on the inside. Such arrangements often require the lamination of the various-sheets to one another, typically with a polyvinyl acetate (PVA) homopolymer emulsion, or an ethylene vinyl acetate (EVA) copolymer emulsion. When these adhesives or emulsions are applied and dried, organic by-products are generated. In particular, for the specific adhesives mentioned, a volatile organic by-product is vinyl acetate.

An aspect of some applications of the present invention is the provision of an alternate adhesive material to polyvinyl acetate or ethylene vinyl acetate copolymers for at least some uses in constructions such as microwave bag constructions.

B. Fluorochemical Treated Papers

As indicated previously, many conventional microwave packaging arrangements comprise a lamination of two sheets of paper, with a microwave interactive construction (typically metallized polymeric film) sandwiched therebetween. The sheet towards the inside of the bag is generally a greaseproof sheet, and the sheet towards the outside of the bag is typically a kraft sheet.

The outside kraft sheet is often a paper which was made with a fluorochemical treatment on its fibers, for grease resistance. A material typically utilized for this process is Scotchban® FC807 (3M, St. Paul, Minn. 55144). The treatment occurs during the paper making process, with the fibers being coated by the fluorochemical material. The treatment renders the paper grease resistant. That is, grease will not readily stain the fibers.

The greaseproof sheet is typically a paper which has been treated during the papermaking process to inhibit passage of grease therethrough. This typically occurs both by refinement and also by chemical treatment with a fluorochemical material.

An aspect of some applications of the present invention is optional avoidance of fluorochemically treated materials (or in some instances reduction in their use or reduction in the amount of fluorochemical treatment involved).

C. Use of Greaseproof Papers Generally

In general, highly refined or chemically treated, greaseproof papers are relatively expensive, by comparison to non-greaseproof kraft papers. If convenient and economical, at least in some systems it would be preferred to avoid such highly refined and/or chemically treated greaseproof papers in microwave bag constructions, and to replace their use with either: a form of kraft paper, perhaps treated or coated for greaseproof character; or, a less highly refined or less chemically treated greaseproof paper.

Herein the term "greaseproof" when applied to paper, refers to the characteristic of resistance to passage of oil or grease therethrough. Evaluations of "greaseproofness" are generally made according to the turpentine test described herein. In general, a greater "greaseproof" character is present, if the length of time measured in the turpentine test described herein is increased. Typically a paper will not be considered "greaseproof" herein unless, when subjected to the turpentine test, a measurement of at least 2 hours and typically at least 3 hours, before staining, is measured.

In general, the characteristic of "greaseproofness" is not completely independent of the quality or refinement of the paper. The paper, for example, may be quite greaseproof in some locations, but possess sufficient porosity (i.e. pin holes) therein, such that even though the cellulosic material is greaseproof, the holes allow for leakage. In general, a paper will not, by itself, be considered greaseproof herein, unless the porosity (i.e. average pin hole population per unit area) as measured by pin hole evaluations described herein, is no greater than about 0.2 holes per square inch.

The characteristic of "greaseproofness" is distinguished herein from the characteristic of "grease resistance". The term "grease resistance" generally refers to the susceptibility of the paper material to staining from grease (i.e. oil/fat). It is not directly related to the susceptibility of the paper material for the passage of oil or grease therethrough, but rather relates to the susceptibility of the paper surface to being stained by the presence of oil or grease that comes in contact therewith. Grease resistance is typically evaluated using a Scotchban® test, described herein. Grease resistant character increases, as the Scotchban® value increases. In general, in the popcorn area a paper material will not be considered "grease resistant" unless it possesses a value, when measured by the Scotchban® test, of at least kit 8. In other food product areas, grease resistance may be associated with other kit levels, for example a minimum kit level of 4, for french fry products.

II. Certain Principles of Processes and Materials According to the Present Invention According to the present invention, advantageous techniques for preparing materials to be utilized in food constructions, such as microwave packaging, are provided. The techniques concern the following:

1. Alternatives to polyvinyl acetates or similar materials in at least some portions of the construction, as the laminating adhesive(s).

2. A treatment alternative for fluorochemically treated kraft paper, to provide desirable grease-resistant characteristics in an outer kraft layer. Alternatively, the techniques may be used in a manner allowing use of a kraft paper in this location which, although fluorochemically treated, has been treated with less fluorochemical than paper used in conventional systems.

3. A provision of a method whereby treated kraft paper can be utilized in place of highly refined, greaseproof paper, for the inner, flexible, sheet in microwave packaging. Alternatively, the techniques may be applied to allow for use, as the greaseproof paper, of a paper which, although fluorochemically treated, has been treated with less fluorochemical than paper used in conventional systems.

4. Utilization of the laminating adhesive as the agent for treating the kraft paper and providing grease resistance.

It is not a necessary part of all applications of principles according to the present invention that the above listed techniques all be applied in a particular microwave construction. That is, for example, selected ones of the techniques may be used to advantage, while retaining conventional practices with respect to others. However, the advantageous techniques described herein are particularly well adapted to be economically applied in a manner to achieve all of them, at least in some systems. This will be apparent from an understanding of the techniques. In particular, preferred starch-based materials or synthetic resins can be applied in manners to achieve all of the recited benefits at least to some extent.

General principles according to the present invention may be applied in a wide variety of manners. The following general characterizations provide some examples.

A. Two-Ply Microwave Packaging

As will be understood from detailed descriptions given below with respect to FIGS. 1–6, a particularly useful embodiment concerns the preparation of two-ply microwave packaging for use in association with microwave cooking of food products, such as popcorn. The invention is particularly well adapted for use in these situations, since the packaging needs to be flexible and expandable, and the techniques can be used in a manner which allow for this.

1. Arrangements Wherein the Inner Ply Is a Greaseproof Paper

In conventional arrangements, microwave popcorn packaging is generally made in two-ply constructions, with the inner ply comprising greaseproof paper. That is, generally the inner ply comprises a paper refined and chemically treated, typically with fluorochemicals, to provide greaseproofness under the turpentine test, preferably of at least 3 hours.

Techniques according to the present invention can be used to improve multi-ply arrangements, wherein the inner ply comprises such greaseproof paper. In particular, even though the inner ply is greaseproof, utilizing preferred materials according to the present invention as laminating adhesive between the inner and outer plies, can enhance or improve greaseproof character. Providing adhesive materials according to the present invention in association with the outer ply, can also improve the grease-resistant character of the outer ply to render an overall more desirable product.

2. Two-Ply Arrangements Wherein the Inner Ply Is Not a Greaseproof Paper

Techniques according to the present invention can be used to allow for avoidance of a greaseproof, i.e., at least 2 or 3 hour minimum turpentine test, paper for the inner ply of a multi-ply construction. This is because when preferred materials are utilized as a laminating adhesive in the multi-ply (for example, two-ply) arrangements, sufficient greaseproof character is provided to the inner ply for operation, even in systems wherein the popcorn charge comprises a charge of unpopped popcorn and fat/oil. Thus, an otherwise unacceptable paper can be used as the inner ply, with greaseproof character in the arrangement being provided and reinforced by the materials of the present invention and not merely resulting from use of refined greaseproof paper.

In addition, in such arrangements, a wide variety of choices are available for the outer ply, since grease-resistant character can be imparted to the outer ply, using the techniques of the present invention. Again, variations and advantages in connection with this are described hereinbelow in connection with the figures and the experiments.

B. One-Ply Microwave Packaging

1. One-Ply Microwave Packaging in which the Bag Construction Comprises Greaseproof Paper Techniques according to the present invention can be used to improve one-ply microwave packaging constructions, in which the bag or inner chamber is formed from a greaseproof (for example, minimum turpentine test 3 hour) material. This is because treatments according to the present invention will generally improve the greaseproof character of such materials, and help ensure against leaks or potential leaks. Also, techniques according to the present invention can be used to improve grease resistance of such materials.

2. One-Ply Microwave Packaging Wherein the Paper Forming the Inner Chamber Does Not Comprise Greaseproof (Minimum 2 or 3 Hour Turpentine Test) Paper The techniques according to the present invention can be used to provide a microwave packaging, one-ply, system wherein the material that forms the inner chamber is not greaseproof (minimum turpentine test of 2 or 3 hour) paper, since the techniques of the present invention can be used to provide a more porous or less greaseproof material, with a desirable greaseproof character. This allows for a wider variety of choices in the paper from which the bag is formed, even when the product is used to enclose a charge of unpopped popcorn kernels and fat. Discussions with respect to this are provided hereinbelow in connection with the drawings and the experiments.

C. Creation of Grease-Resistant Laminates

Techniques according to the present invention can be used to prepare grease-resistant laminates or constructions for use in products or materials other than microwave popcorn packaging. In general, the descriptions hereinbelow will indicate how paper that is not very grease resistant (for example that is not minimum kit 8) can be rendered to have an improved grease resistance. In addition, the techniques can be used to provide laminates of paper, neither layer of which has such a grease-resistant character, with an overall grease resistance that is, for example, above kit 8. These laminates can be used as grease-resistant containers or wrappings for a wide variety of foods and food products. They are particularly desirable since they can be provided with a flexible, wrappable character.

III. Microwave Packaging for Popcorn Including Improvements According to the Present Invention The reference numeral 1, FIG. 1, generally depicts a microwaveable popcorn package incorporating the various advantages according to the present invention. In FIG. 1, package 1 is depicted as it generally would appear when unpackaged from its protective outer wrap, and positioned by a consumer in a microwave oven for use. Prior to this step, packages such as package 1 are often stored and sold in a "trifold" configuration, with folding being generally about fold lines A and B. In the trifold configuration, the arrangement is generally sold and stored in a protective moisture barrier outer wrap, not shown. These have been conventionally utilized for a wide variety of microwave bags.

In general, microwave popcorn package 1 comprises a flexible outer bag 2 including a charge of popcorn or popcorn and fat therein. In use, during exposure to microwave energy, the popcorn is popped and the bag expands. This is described, for example, in U.S. Pat. Nos. 5,044,777 and 5,081,330, incorporated herein by reference. In this context, the term "flexible" is meant to refer to a bag material which is not so stiff or rigid as to undesirably interfere with bag expansion during use. Alternately stated, the term is used to refer to a material that can be readily folded and unfolded.

In general, prior to popping, the popcorn is retained in central region 5, of bag 2. In this region, the unpopped popcorn charge would generally be positioned oriented above a microwave interactive construction. During the popping operation, moisture inside the popcorn kernels absorbs microwave energy, generating sufficient steam and heat for the popping operation. In addition, the microwave interactive construction absorbs microwave energy and dissipates heat, facilitating the popping process. In preferred constructions, the microwave interactive construction occupies central region 5, but not, to a substantial extent, other portions of the popcorn package 1. That is, microwave interactive material is preferably confined to the region where it will be in proximity with, and mostly where it will be covered by, a popcorn charge in use. This is preferred, at least since it leads to efficient utilization of the microwave interactive material and also because it results in preferred heat transfer and heat retention in connection with the popping process.

Figure 2:
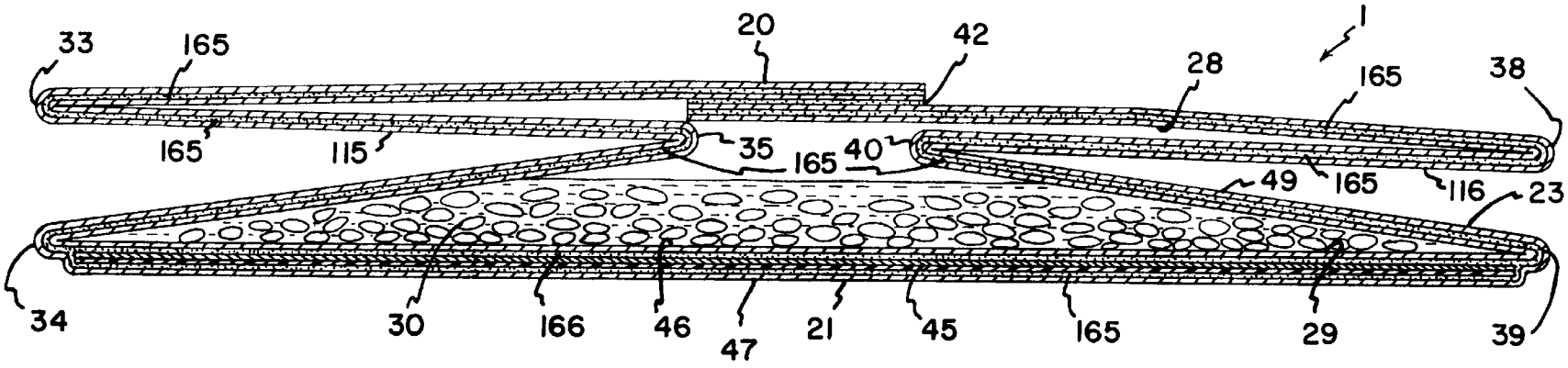
FIG. 2 is a cross-sectional view of the construction shown in FIG. 1.

Attention is now directed to FIG. 2, a cross-section taken generally along line 2—2, FIG. 1. From review of FIG. 2, it will be understood that the popcorn package 1 generally comprises first and second opposite panels 20 and 21, joined by first and second opposite side gussets 22 and 23.

The gussets 22 and 23 generally separate popcorn package 1 into first and second expandable tubes 28 and 29. Popcorn charge 30 is initially positioned and substantially retained within tube 29. Tube 28, prior to popping, is generally collapsed. Indeed, in preferred arrangements, tube 28 is sealed closed by temporary heat seals, prior to heating in the microwave oven. Still referring to FIG. 2, side gusset 22 generally comprises edge folds 33 and 34 and inwardly directed central fold 35. Similarly, gusset 23 comprises edge folds 38 and 39 and inwardly directed central fold 40. Package 1, for the arrangement shown in FIG. 2, is folded from a multi-ply (i.e. a double-ply) blank. Thus, panel 20 includes central longitudinal seam 42 therein. Folds such as folds 33, 34, 35, 38, 39 and 40 are widely used for flexible microwave packaging, for example they are shown at U.S. Pat. Nos. 5,044,777 and 5,195,829, and products using such folds are available under the commercial designation ACT II® from Golden Valley Microwave Foods, Inc. of Edina, Minn., the assignee of the present application. The folds 33, 34, 35, 38, 39 and 40 define, inter alia, gusset panels 48 and 49.

The popcorn charge 30 may in some cases comprise unpopped kernels, in some instances flavored unpopped kernels, and in some instances it may comprise a mixture of unpopped kernels and oil/fat. When the charge 30 comprises a mixture of unpopped kernels (whether flavored or not) and oil/fat, generally and preferably the oil/fat will be a material which is liquified at about 105° F. Under such circumstances, generally for preferred systems the weight of kernels to weight of oil/fat will preferably be in the range of about 2:1 to 20:1.

Underneath popcorn charge 30, arrangement 1 includes microwave interactive construction or susceptor 45. The microwave interactive construction 45 may be of conventional microwave interactive stock. In the particular multi-ply (two-ply) arrangement 1 depicted, it is positioned between layers or plies 46, 47 from which flexible construction 1 is folded. In some more recently designed systems, for example the alternate embodiment depicted in FIG. 7 and described below, the microwave interactive material is a sheet of material secured to a single ply of material from which the flexible construction is folded, see for example U.S. Ser. No. 08/389,755 filed Feb. 15, 1995, the disclosure of which is incorporated herein by reference. Certain of the principles according to the present invention may be utilized with either type of system, i.e., the 1-ply or the multi-ply bag.

Preferred microwave interactive constructions for arrangements according to the present invention, are described herein below. Preferably when the microwave interactive construction is a laminate as described hereinbelow, it extends past fold lines A and B, FIG. 1, somewhat. Preferably it extends toward the openable top end 93, past fold line A about 0.4–1.0 inches; and, it extends toward bottom end 90, i.e. past fold line B, about 0.25–0.5 inches. The reason it is preferred that it extend somewhat further toward the top openable end 93 than the bottom closed end 90 is that generally the V-seals, described hereinbelow, at the bottom end, are a bit larger than the V-seals, described below, adjacent the top end. This will be apparent from the drawings and description relating to FIGS. 3 and 4.

Figure 3:
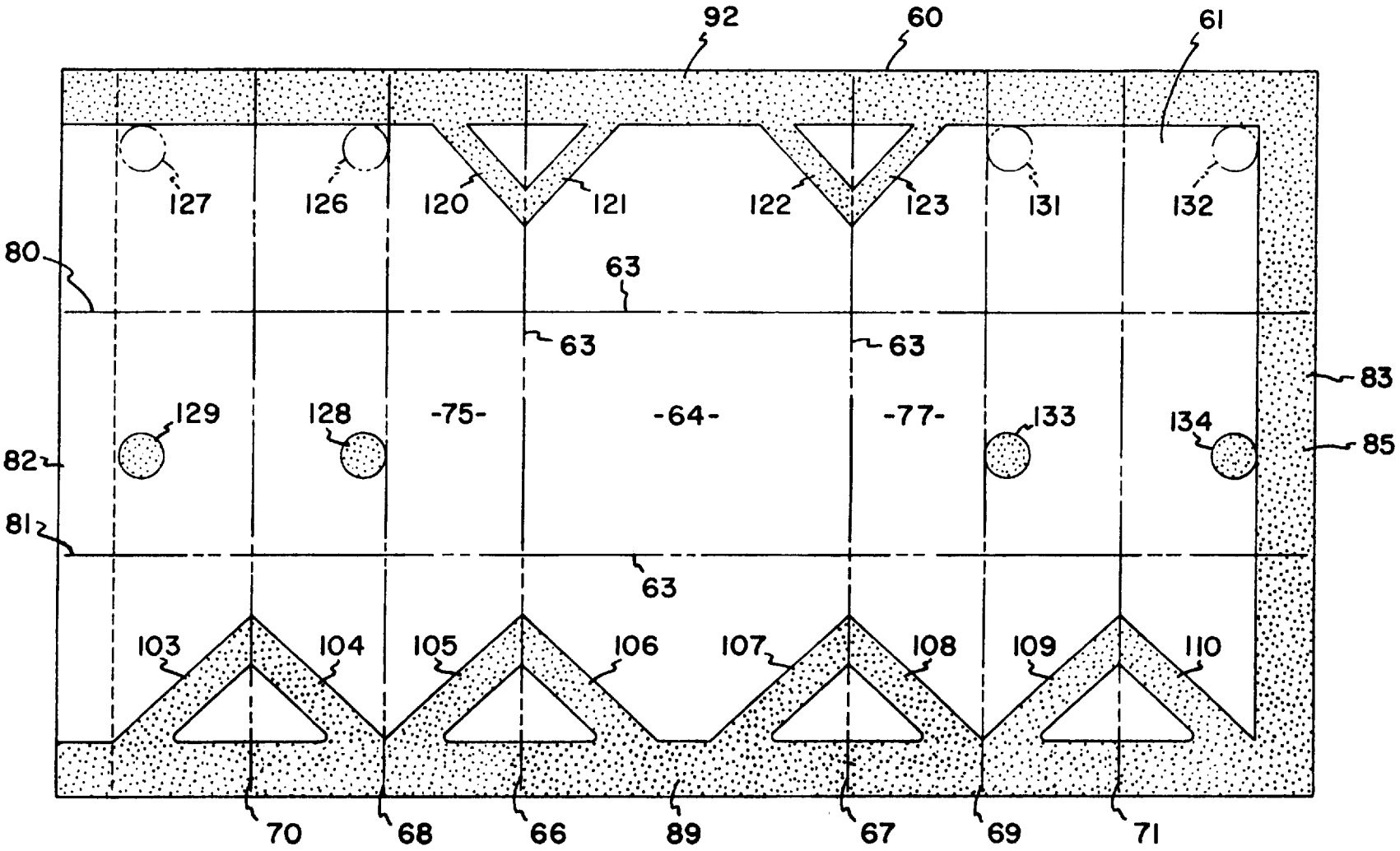
FIG. 3 is a plan view of the inside surface of a blank from which the arrangement of FIGS. 1 and 2 can be folded.

Attention is now directed to FIG. 3. FIG. 3 is a top plan view of a panel, sheet or blank 60, from which an arrangement according to FIGS. 1 and 2 can be folded. Many of the features illustrated in FIG. 3 are generally known features, for example shown and described in U.S. Pat. Nos. 5,195,829 and 5,044,777.

Figure 4:
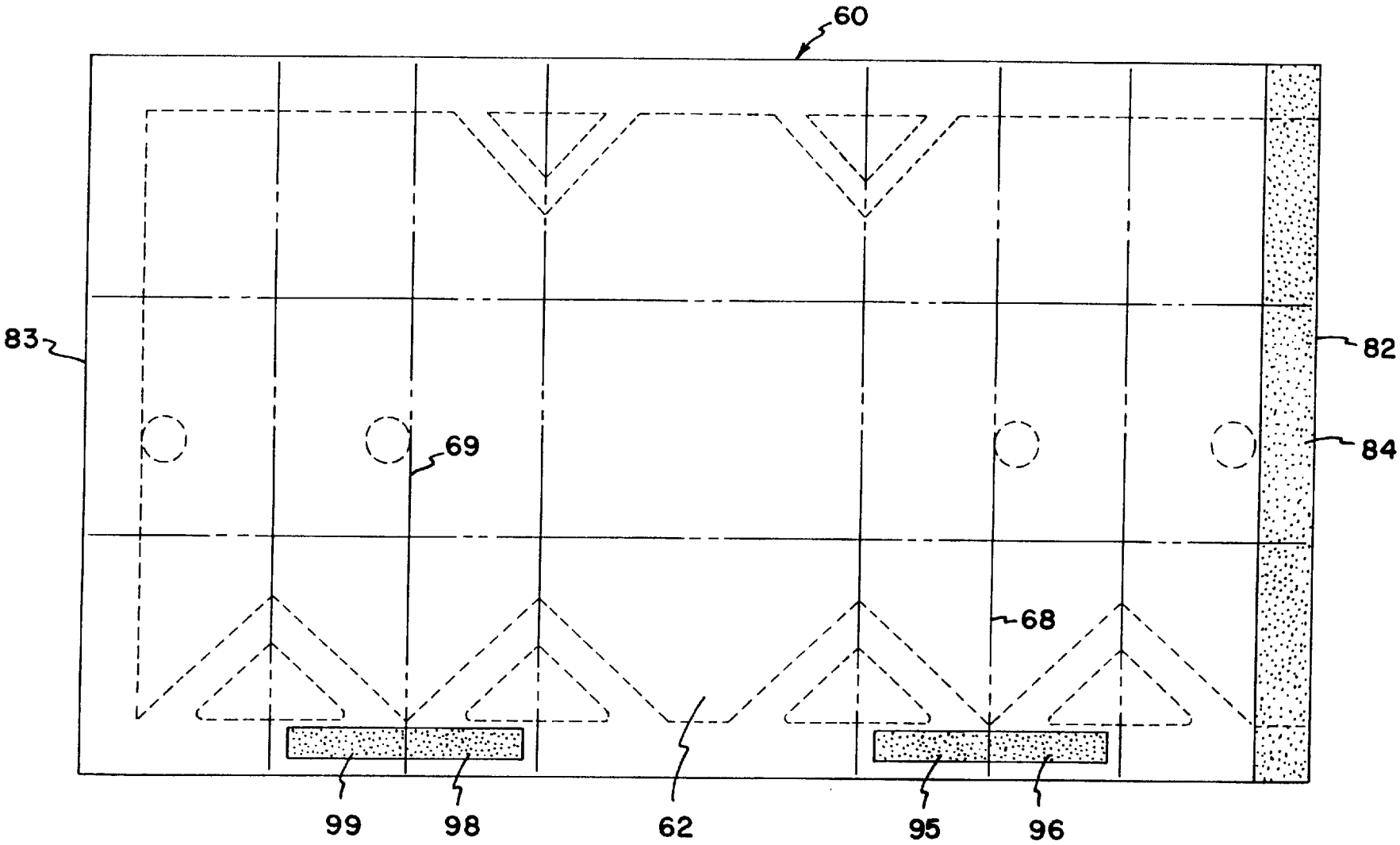
FIG. 4 is a bottom plan view of the blank shown in FIG. 3.

The view of FIG. 3 is of what is sometimes referred to as the "backside" of panel 60, i.e., the side 61 of panel 60 which forms the interior surface of the assembled bag construction 1, FIG. 1. The side opposite the side viewable in FIG. 3, which is depicted in FIG. 4 at 62, is sometimes referred to as the "front side", and forms the exterior surface of the bag construction 1. Thus, referring to FIG. 3, panel 60 comprises a sheet of flexible material from which arrangement 1 is folded, and panel 60 includes various sealant fields thereon, to generate desired features.

Still referring to FIG. 3, phantom line segments 63 define a region 64 with which at least a portion of a microwave interactive construction, such as construction 45, will be associated in use. The perimeter defined by phantom lines 63 also indicates a location on surface 61 whereat the popcorn charge will eventually be positioned, in use. The microwave interactive construction, for example interactive construction 45, FIG. 2, may be positioned on the interior of the construction 1, on the exterior, or between plies. In general, for preferred embodiments such as those shown in FIGS. 1 and 2, microwave interactive construction 45 will be positioned between plies. For the embodiment shown in FIG. 7 it is preferably on an exterior surface of the package.

Referring to FIG. 3, the surface 61 viewed is the surface which, when package 1 is folded, forms the interior surface of the construction. The popcorn charge 30, then, will eventually be positioned over central region 64, defined by parameter lines 63.

Still referring to FIG. 3, line 66 generally indicates where fold 34, FIG. 2, will be formed; and, line 67 generally indicates where fold 39, FIG. 2, will be formed. Similarly, line 68 corresponds with fold 35 (FIG. 2), line 69 with fold 40 (FIG. 2), line 70 with fold 33 (FIG. 2) and line 71 with fold 38 (FIG. 2). Thus, region 75, between fold lines 68 and 66, will eventually define panel 48, FIG. 2; and, region 77, between fold lines 67 and 69, will eventually define panel 49, FIG. 2.

Referring to FIG. 3, in general folds A and B (FIG. 1) are eventually formed by folding the overall arrangement such that folds along lines 80 and 81, respectively, are created. This later folding would generally be after the bag construction, FIGS. 1 and 2, is assembled.

Attention is now directed to FIG. 4. FIG. 4 is a view of panel 60, shown flipped over, relative to FIG. 3. For orientation, in FIG. 4, edges 82 and 83 are opposite to FIG. 3. Sealant field 84 is used to engage field 85 (FIG. 3), during folding (with heat sealing), to form longitudinal seam or seal 42, FIG. 2.

Referring to FIG. 3, during folding (and with heat sealing), various portions of field 89 will engage one another to form end seal 90, and various portions of field 92 will engage one another to form end seal 93, FIG. 1. In general, end seal 90 is located at a "top end" of the construction, and is sized and configured to vent under internal steam pressure, during use. End 93, on the other hand, forms the bottom end and remains sealed during use. The consumer's typical access to the popcorn is through "top" end 90. This is described in the '777 patent referenced above.

Portions of each of sealant fields 95 and 96, on an underside of panel 60, FIG. 4, will engage (overlap) one another when folding around fold line 68 is conducted (with heat sealing), to help secure panel 60 in a preferred configuration, after folding. This is analogous to what was done in the arrangement of U.S. Pat. No. 5,195,829, FIG. 1(*a*), at sealant fields 82 and 84. Similarly, sealant fields 98 and 99, on an underside of panel 60, FIG. 4, engage one another (with heat sealing) when the panel is folded about fold line 69.

Referring again to FIG. 3, attention is now directed toward sealant fields 103, 104, 105, 106, 107, 108, 109 and 110, sometimes referred to as V-seals or diagonal seals. Analogous fields were shown in U.S. Pat. No. 5,195,829, FIG. 1, at reference numerals 64-67. During folding, portions of fields 103–110 engage (overlap) one another, to retain selected portions of the panel tacked to one another (with heat sealing) and to provide for a preferred configuration during expansion. In particular, field 103 engages field 104, field 105 engages field 106, field 108 engages field 107, and field 110 engages field 109, during folding (and heat sealing). Engagement between fields 105 and 106, and also fields 108 and 107, tends to retain selected portions of panels 48 and 49 secured to panel 21, FIG. 2, in regions where the popcorn charge is not located, in the collapsed folded trifold. Sealing of field 103 against 104, and field 110 against 109, helps retain panels 115 and 116 sealed against panel 20, FIG. 2, in the collapsed trifold. This helps ensure that the popcorn charge 30, FIG. 2, is substantially retained where desired in the arrangement. Advantages from this are described in part in U.S. Pat. No. 5,195,829.

Referring again to FIG. 3, attention is now directed to sealant fields 120, 121, 122 and 123. When the arrangement is folded about fold line 66, sealant field 120 engages (overlaps) sealant field 121; and, when the arrangement is folded about fold line 67, sealant field 123 engages (overlaps) sealant field 122. The engagement (after heat sealing) between fields 120 and 121 further ensures that panel 48 will be sealed against panel 21; and, the engagement between fields 123 and 122 will further insure that panel 49 is sealed against panel 21. This is similar to the utilization of fields 68, 70, 71 and 72, FIG. 1, of U.S. Pat. No. 5,195,829. Fields 105, 106, 107, 108, 120, 121, 122 and 123 help ensure that the central section 5, FIG. 1, will remain relatively flat, as the bag expands in use.

Attention is now directed to sealant fields 128, 129, 133 and 134. These are also used to insure that panels 115 and 116 are sealed against panel 20, FIG. 2, so that the unpopped popcorn charge 30 is retained in tube 29, and does not substantially flow into tube 28 until desired during heating. In particular, fields 128 and 129 are oriented to engage (overlap) one another, when the arrangement is folded about fold line 70; and, fields 133 and 134 are oriented to engage (overlap) one another, when the arrangement is folded about fold line 71. Similarly, engagement between fields 103 and 104, and also between fields 109 and 110, ensures that tube 28 is maintained collapsed, until the bag begins to expand as the steam is generated and the popcorn pops. Optionally, fields 126 and 127 and fields 131 and 132 can be used, to further ensure that panels 115 and 116 are sealed against panel 20 in a desirable manner.

Seals of the type associated with fields 128, 129, 133 and 134 have been used in previous constructions. See for example, U.S. Pat. No. 5,044,777, FIG. 1, at 42, 44, 46 and 48.

In general, the material utilized for the end seals 90, 93 and seals involving regions 103, 104, 105, 106, 107, 108, 109, 110, 120, 121, 122, 123, 128, 129, 133 and 134 is preferably a heat sealable material, activated through the use of conventional type heat sealing equipment. That is, sealing does not occur merely upon contact, but rather requires some application of heat, such as the heating jaws of heat sealing equipment for activation. This is preferred in part because it allows the seal material to be applied using printing equipment, to rollstock. Thus, the rollstock can be rolled up without various layers of the arrangement becoming adhered to one another.

IV. Improvements According to the Present Invention

Reference numeral 165, FIG. 2, indicates the laminating adhesive between: portions of the outer ply 47 and the susceptor construction 45; and, portions of the inner ply 46 and the outer ply 47. As explained above, in many conventional arrangements, the adhesive utilized in these regions is a polyvinyl acetate adhesive or ethylene vinyl acetate adhesive, capable of releasing some vinyl acetate during drying.

Reference numeral 166 identifies the laminating adhesive between the "metal" side of the microwave interactive construction 45 and the adjacent paper stock, i.e. the inner ply 46. For reasons provided hereinbelow, the adhesive located in region 166 may, in preferred applications, comprise a different material than used in regions 165. Indeed, the adhesive in region 166 will preferably comprise an adhesive of the type conventionally used in microwave popping bags, at this location. Thus, it will preferably be an ethylene vinyl acetate material.

According to the present invention, the laminating adhesive 165 in the regions or locations described is preferably not a polyvinyl acetate adhesive. Preferably it is an adhesive which will impart preferred greaseproof character, grease-resistant character, or both to the paper in these locations. A usable material to achieve this effect is a starch-based adhesive. The preferred starch-based adhesive, which has been found to be useful to provide a secure construction, is the commercially available adhesive product 71-4253 available from National Starch and Chemical, Co., Minneapolis, Minn. 55344. This is a liquid corn starch-based adhesive. In preferred use, generally the commercial product should be diluted, typically and preferably with about 0.5 gallons of water being added to about 15 gallons of the commercial product. This material has been found useful even in certain regions in the immediate vicinity of microwave interactive material or in the presence of portions of the arrangement which will become relatively hot due to heat transfer from hot popcorn and steam generated within the system and/or from hot oil or fat contained within the system.

An alternative starch-based adhesive usable is NS-Redisize 100, also available from National Starch and Chemical, Co. In general this material is not as preferred because it is somewhat thick and not as easy to apply and evenly dry.

It is noted that the same adhesive need not necessarily be used in all regions 165. However, it will typically be convenient to do so. Not all starch-based adhesives are usable to obtain the preferred advantages. In general, with some starch-based adhesives it has been noticed that although lamination is effective, grease resistance and/or greaseproofness is unsatisfactory. Hereinbelow various tests are provided for defining the grease-barrier capabilities of papers treated according to the present invention. One of these is a turpentine test, used to define greaseproofness. In general, desired adhesives, including starch-based adhesives, usable according to the present invention are those which when applied between layers of paper in a test laminate as described and when tested as described, in the laminate, will provide a measured time to stain penetration under the turpentine test of no less than 2 hours, preferably no less than 3 hours, and most preferably no less than 24 hours. The preferred starch-based material 71-4253, described above and applied as described below, is observed to provide such a desirable greaseproof character.

Another characteristic of importance to certain grease properties is grease resistance. A test described hereinbelow for considering the grease-resistant properties of paper is the Scotchban® test. Preferred adhesives, including starch-based adhesives, according to the present invention are those which when applied to a paper sheet and tested as described will provide a minimal measurement on the Scotchban® test of at least kit 8.

In some instances, synthetic resins can be utilized as an alternative advantageous adhesive to starch-based adhesive. Usable materials include H.B. Fuller WB9039 or WB9040 synthetic resins, available from H.B. Fuller of St. Paul, Minn. This type of material can be utilized in two-ply arrangements on both the inner ply and the outer ply. Another usable synthetic material is Franklin International polyvinyl alcohol-based adhesive available under the trade designation EX No. TA-4-7 from Franklin International of Columbus, Ohio. This material, which Franklin International presently designates as an experimental material, appears to at least be usable as an alternative to fluorochemical treatment on the outer layer of material in a multi-ply arrangement. That is, it can provide improved grease resistance.

An alternate way of identifying adhesives which are usable or preferred according to the present invention, is stated with respect to use to improve the operation of the paper layers involved. In particular, consider a paper whose "grease-resistant" or "greaseproof" properties are being improved. For example, if the paper is one that, when tested hereinbelow either alone or in a laminate with a conventional polyvinyl acetate adhesive, provides a Scotchban® grease resistance of less than kit 8 or greaseproofness of some measured turpentine test value; and, when the conventional polyvinyl acetate is replaced with the replacement adhesive a greater than Scotchban® minimum kit 8 or a measured increase in greaseproofness by the turpentine test results, then the replacement adhesive used is one which is advantageous according to some of the principles of the present invention.

As indicated above, for conventional systems outer ply 47 comprises kraft paper, which during its production has been treated for grease resistance with a fluorochemical such as Scotchban® FC807 to achieve a grease resistance of minimum kit 8. In certain improved arrangements according to the present invention, grease resistance in the outer ply is provided simply by using, as the treatment material, a preferred adhesive as described above, in application to an otherwise not minimum kit 8, and preferably not chemically treated (for grease resistance), kraft paper.

It has been found that, in general, the preferred adhesive materials described can be used to obtain improved grease-resistant character in the outer ply of kraft paper without the need for a fluorochemical treatment. Alternatively, even the performance of a fluorochemically treated kraft paper, having a Scotchban® test value of less than (for example) kit 8, can be improved by using a treatment as described herein.

Also as indicated above, for typical conventional arrangements the inner ply 4G comprises a greaseproof paper. In certain applications according to the present invention, the inner ply can be formed from a kraft paper to which has been applied adhesive according to the present invention. Alternatively, the performance of an inner ply of greaseproof paper, having a Scotchban® test value of less than kit 8, or a low grease-resistant character, can be improved by using a treatment as described herein.

V. Processes for Preparing Preferred Constructions

Figure 5:
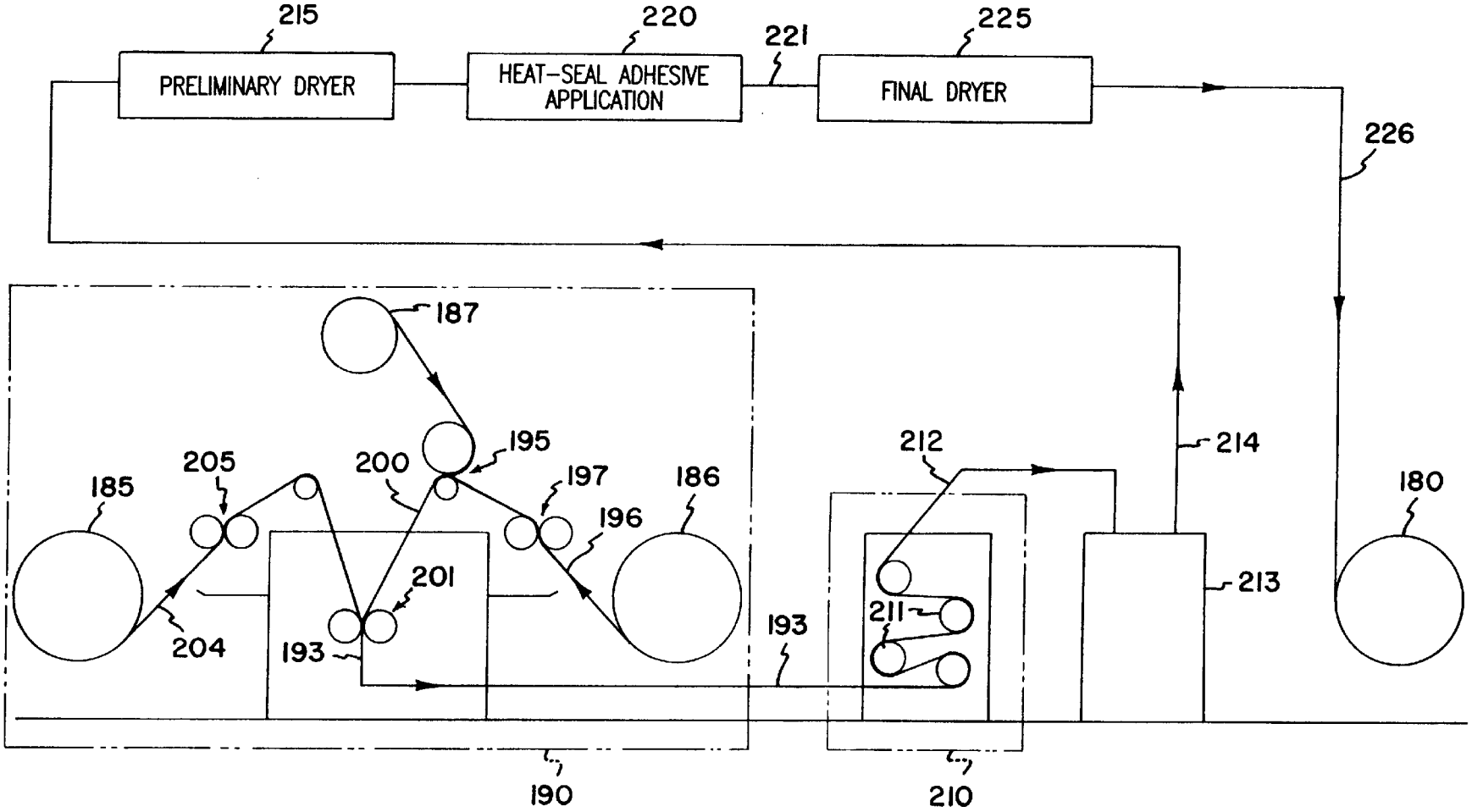
FIG. 5 is a schematic view of a process for preparing a rollstock of blanks according to FIGS. 3 and 4.

Attention is now directed to FIG. 5, which is a schematic representation for practicing certain preferred processes according to the present invention, to prepare rollstock from which advantageous microwave bag constructions can be made. It will be understood that a wide variety of techniques and methods can be used to prepare desirable rollstock. FIG. 5, and the discussion related thereto, is presented as an example of a usable technique. Many features of the operation shown in FIG. 5 are not necessarily preferred for any reason other than that they are readily made variations to a process already used to make conventional packaging, in which none of the adhesive materials for grease-resistance and greaseproofness according to the present invention were used, and in some instances different paper feedstocks were used. That is, except for specific modifications to address the utilization of adhesive materials and papers according to processes described herein, to make arrangements according to the present invention, the arrangement of FIG. 5 generally corresponds to production facilities previously used for the creation of conventional microwave packaging, by or under the direction of the assignee of the present invention.

Referring to FIG. 5, the rollstock prepared according to the schematic shown therein, is one which provides a rollstock of material having two plies of paper, with a microwave interactive material positioned therebetween. Thus, the rollstock prepared in the schematic of FIG. 5 could be used to prepare an arrangement such as that shown in FIGS. 1 and 2.

Referring to FIG. 5, the final rollstock material prepared according to the process is indicated generally at 180. The three feedstock materials used, are indicated generally at 185, 186 and 187.

Feedstock 187 comprises the microwave interactive construction, pre-prepared for use in processes according to the present invention. Thus, in general, feedstock 187 would comprise continuous metallized polymeric film. In typical preferred arrangements, the metal would be deposited and positioned on only one side of the polymeric film. The metal film need not cover the entire side on which it is applied, and may be presented in a pattern.

The feedstock indicated at 186 comprises the material which, in the overall assembly, will form the ply corresponding to the inside ply of the bag. In certain applications described herein, it may comprise a kraft paper. In some applications, it may be a greaseproof paper.

Feedstock 185 generally corresponds to the material which will form the outer ply, and thus is typically a bleached kraft paper. In some applications, it will eventually be printed on, so it will often be a material which has a machine glazed finish. In some applications, it will be a material which has been treated with a fluorochemical treatment for grease-resistance. In others, it will not.

In FIG. 5, phantom lines 190 identify a first stage or stage 1 of the process. In this stage, the various feedstocks are laminated together to form a continuous feed or web 193, fed to downstream processing.

In general, referring to stage 1, 190, the processes conducted are as follows. Continuous feedstock 187 of microwave interactive material is fed to station 195, simultaneously with feedstock 186. At station 195, the two are laminated to one another. In general then, at station 195, a knife blade or cutter will be used to cut selected pieces of microwave interactive material from feedstock 187 for positioning on continuous paper stream 196. Conventional arrangements for cutting, such as those schematically shown in U.S. application Ser. No. 08/388,755, FIG. 11, may be used. At station 197, paper feed 196 from feedstock 186 has applied thereto an adhesive in an appropriate location for receipt of a section of microwave interactive construction to be laminated. Preferably the microwave interactive material comprises a sheet of polymeric material with a metal layer deposited on one side thereof. Preferably, the microwave interactive material is secured to web 196 with the metal layer positioned between web 196 and the polymeric sheet.

Preferably the adhesive applied at station 197 is an ethylene vinyl acetate copolymer adhesive. A usable, commercially available, product is Product No. WC-346OZZ from H.B. Fuller of Vadnais Heights, Minn.

It is noted that the particular preferred adhesive described above, as being positioned between the metal side of the microwave interactive material and the inner web 196, is not an adhesive which imparts substantial greaseproof character to the inner layer 187 or the overall laminate, according to the present invention. Rather, it is an adhesive which has conventionally been used in such laminations. A reason for this is that the presently identified preferred adhesives identified as usable in arrangements according to the present invention, for example starch-based adhesives as indicated above, do not perform well (as adhesives) when in direct contact with the metal of the microwave interactive material. In general, when such adhesives are brought into direct contact with the metal of microwave interactive susceptor, an undesirable propensity for delamination at this location is observed.

It is noted, however, that this does not mean that a greaseproof character will be lacking in the region of the ultimate composite whereat the patch of microwave interactive materials applied. First, the plastic substrate of the microwave interactive material provides a substantial barrier to passage of grease therethrough. Also, in steps described hereinbelow, a laminating adhesive will be applied between the web, 200, with patches thereon, and a web of paper, 204, brought into contact therewith. This laminating adhesive will provide for grease barrier properties, in preferred applications, to both the web which forms the inner sheet of the resulting product and also to at least those portions of the web which form the inner ply, but which are not covered by the microwave interactive construction patch.

At station 197 printing techniques, such as flexographic or gravure techniques, can be used to apply this adhesive.

Still referring to stage 1 (Ref. 190), at 200 a continuous feed of paper from rollstock 186, with patches of microwave interactive construction from feedstock 187, is depicted directed toward station 201. Simultaneously paper stock from feedstock 185 is shown directed to station 201 as a continuous web 204. At station 205, the laminating adhesive is applied to web 204. The laminating adhesive may be applied, for example, using flexographic or gravure techniques.

In certain preferred applications, the laminating adhesive applied at station 205 to web 204 will be an appropriate material to impart some grease barrier character to web 204.

At station 201, web 200 is pressed through a roller bite and is laminated, in a continuous operation, to web 204, with microwave interactive material therebetween, to form web 193.

Attention is now directed to the portion of the process identified within phantom lines 210. When the laminating adhesive is a material which needs to be cured, such as a starch-based adhesive, this generally comprises a stage (stage 2), at which the adhesive is "cured". For example, starch-based adhesives or starch-based laminating materials typically require substantial heat to be acceptably cured. Typically they need to be exposed to temperatures on the order of about 150° to 200° F. for a brief period of time to achieve an irreversible cure. This can be readily accomplished in a continuous web process by feeding web 193 around (or between) heated or hot rollers 211, sometimes referred to as "hot cans". The heated rollers transmit sufficient heat to the web 193 to result in the formation of a continuous, cured web 212.

In general, it will be desired to provide printing or graphics on the outside of packages made from webs prepared according to the process. This can be conducted by directing the cured web 211 through a printing press (stage III), as indicated at 213. A wide variety of printing press arrangements can be used, including ones for applying multicolor printing or graphics. In general, at 214, a continuous, printed web is shown exiting the printing press 213.

In addition, in press 213, a grease-resistant treatment can optionally be applied to the surface of the web 212, which will become the outer surface of the package in use. This can be done either before or after the printing. In general, the treatment can be applied by a printing press analogously to the application of printing. In some applications, the same material that is applied as the laminating adhesive at station 205, is applied to the outer web in press 213, to provide a desirable grease-resistant character to the outer ply 196. In other applications, different materials can be used as the adhesive between the plies, and as the treatment on the outer surface of the outer ply.

After exiting the press 213, with any desired printed indicia on the web and also any desired applied grease-resistant treatment, continuous web 214 is directed into a preliminary dryer 215. In general, in the dryer 215, the ink and the grease-resistant treatment are dried. Typically the dryer will comprise a forced-air dryer system running at about 150° to 250° F. The residence time in the dryer need only be sufficient to obtain a desired level of drying for the web. Typically a residence time sufficient to get a web temperature of 150° F. to 190° F. is preferred.

In typical applications, at this point it is still necessary to apply to the web, on appropriate surfaces thereof, the pattern of heat-seal adhesive to be used to form the desired seals when the bag is constructed. These would generally correspond to the fields of sealant indicated in FIGS. 3 and 4. In the schematic of FIG. 5, this step is represented as conducted at station 220. The heat-seal adhesive can be applied by conventional techniques, for example, using gravure or flexographic printing.

In general, at 221, the continuous web is shown with the heat-seal fields applied thereto, being fed into a final dryer 225. In the final dryer, the heat-seal adhesive is dried, final drying of the ink occurs, and a final drying or curing of the starch-based adhesive (if used) takes place. In general, this can be conducted readily with a forced-air dryer system, typically set at about 250° to 400° F.

At 226, the completed continuous web is shown being directed into final rollstock 180.

In the process thus far described, the fields of heat seal material (for example fields 95, 96, 98 and 99, FIG. 4) are applied after the application of grease-resistant treatment. This is preferred, especially if the grease-resistant treatment is being applied over the entire (outer) surface of a web. A reason for this is that when grease-resistant treatments, such as adhesives described herein, are applied over heat sealant fields, they tend to interfere with operation of the heat seal fields. However, if appropriate printing and registration techniques for application of both the heat seal field and the adhesive field are used, the heat seal field can be applied before the grease-resistant treatment is applied.

Processes such as those shown in FIG. 5 can be conducted to prepare printed rollstock with more than one sheet or bag oriented adjacent one another, on the final rollstock 180. This could later be split or cut to form Individual streams to be fed into continuous bag-forming operations. A particularly convenient manner for orienting the printed bag blanks continuously on the webs to form a desirable rollstock 180, is with printed patterns of bags oriented side-by-side but rotationally offset by 90° (on the roller during printing). This helps ensure smooth operation of the application system, especially where the anilox transfers ink to the plates.

Figure 6:
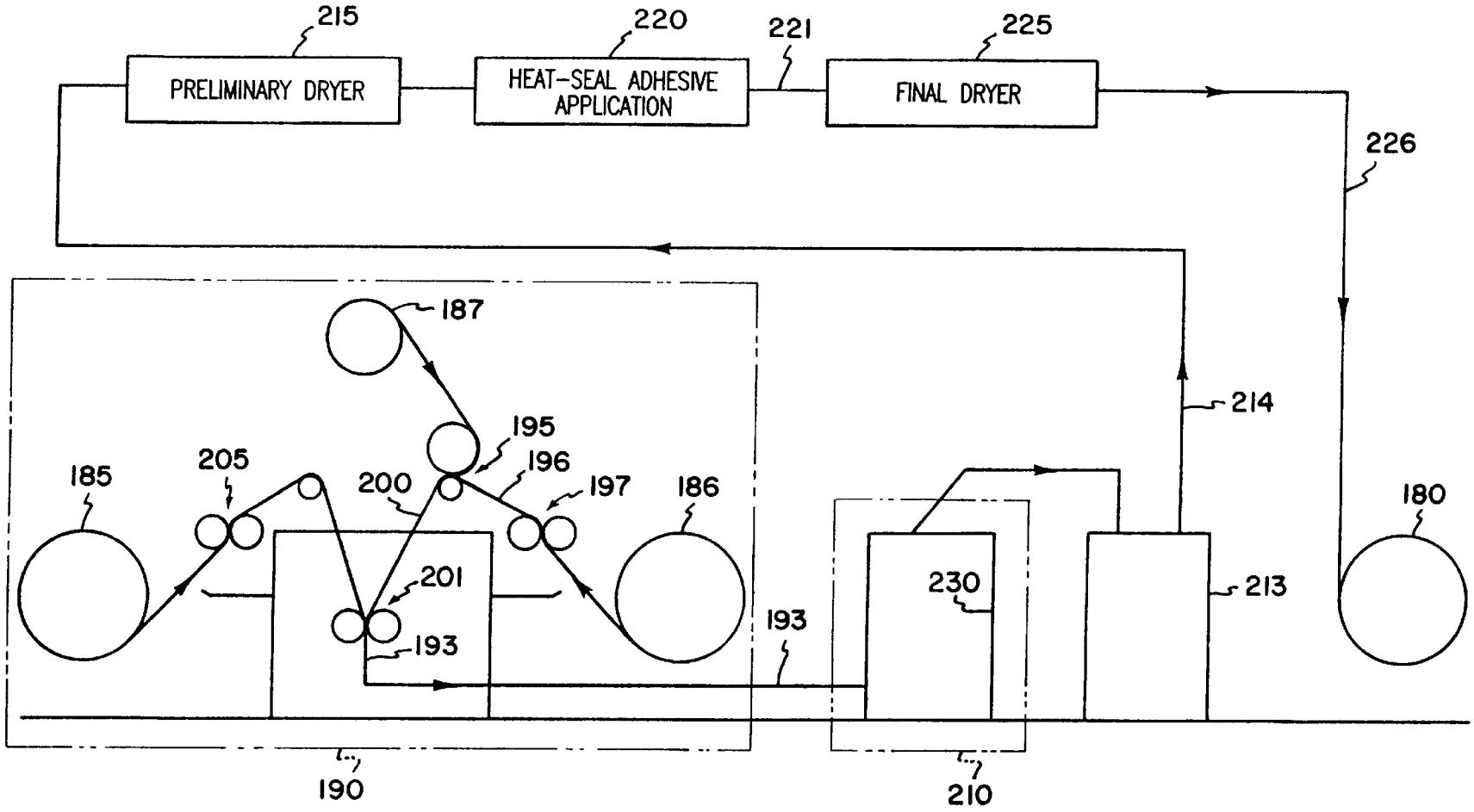
FIG. 6 is a schematic view of an alternate process for preparing a rollstock of blanks.

Attention is now directed to the schematic shown in FIG. 6. FIG. 6 is generally analogous to FIG. 5, and the same reference numerals are utilized to indicate similarly operating portions. In the arrangement of FIG. 6, as an alternative to using a hot roller or hot can system (as was indicated in FIG. 5 at 210) a forced-air drying system 230 is used. In general, it is foreseen that it would be conducted with air at about 100° to 200° F., depending primarily on the particular adhesive chosen and the residence time.

An Alternative Embodiment

Figure 7:
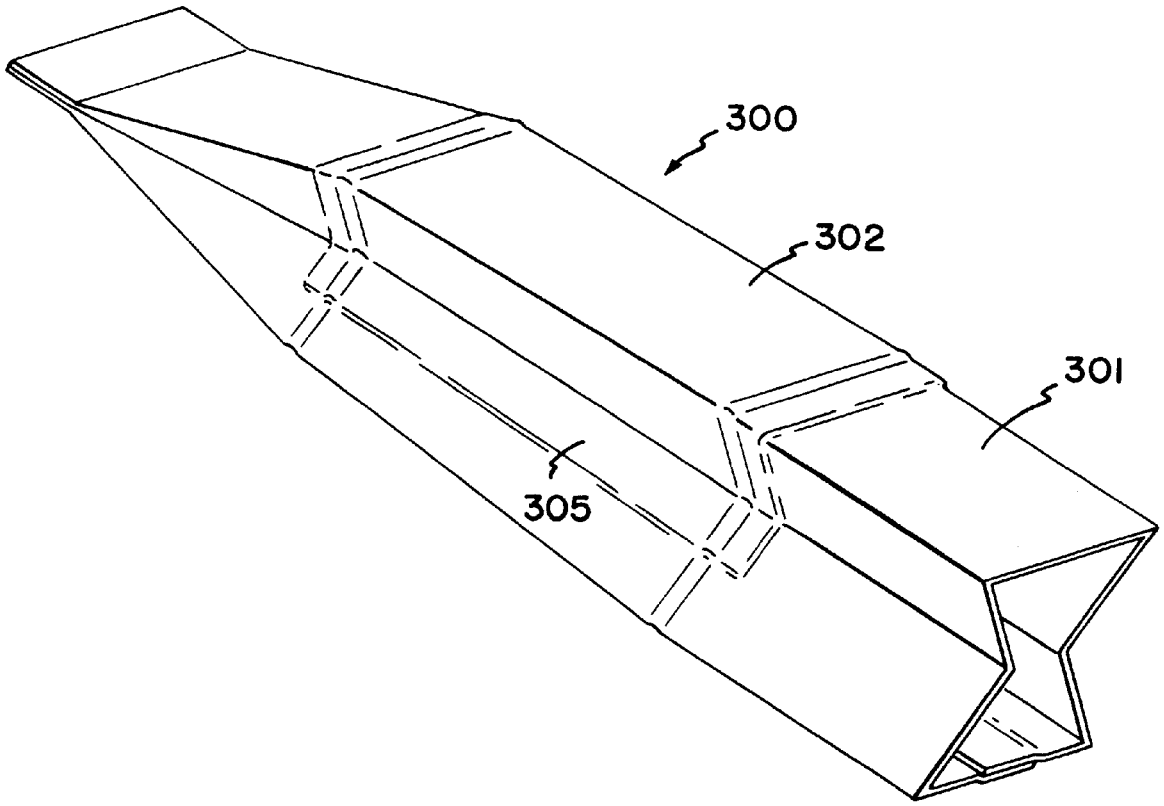
FIG. 7 is a perspective view of an alternate embodiment to that shown in FIG. 1.

Attention is now directed to FIG. 7. In FIG. 7, a perspective view is presented, of an alternate bag arrangement according to the present invention. The bag arrangement depicted in FIG. 7 is shown with one end open.

Referring to FIG. 7, bag arrangement 300 comprises a single ply of material 301 having microwave interactive construction 302 secured thereto. Such arrangements are described, for example, in U.S. Ser. No. 08/389,755, incorporated herein by reference. In general, material 301 comprises greaseproof paper material, or kraft paper which is has been treated according to the present invention to be greaseproof.

Microwave interactive construction 302 is preferably secured to material 301, through use of the preferred adhesive described above for securing the metal side of construction 45 to the inner ply, at 166. In general, microwave interactive construction 302 comprises an outer sheet of paper having, laminated thereto, a metallized polymeric film. The construction comprising the outer paper and the metallized polymeric film is then laminated to material 301, preferably with the metal layer directed toward the bag 300. The outer paper sheet of microwave interactive construction 302, shown generally at 305, preferably comprises a kraft paper, and most preferably a kraft paper which has been treated for grease resistance. Techniques described herein to provide grease resistance in kraft paper without fluorochemical treatment can be utilized to provide the grease-resistant character in sheet 305, if desired.

Thus, in general, FIG. 7 depicts a bag arrangement 300 utilizing various optional materials according to the present invention, to advantage, in a construction wherein the bag is folded from a sheet of material of only 1-ply, with more than one ply only being present in those locations whereat the microwave interactive construction or susceptor 302 is positioned.

VI. Preferred Materials

Preferred materials will, in general, depend upon the particular embodiment. At the present, preferred materials are as follows.

For the two-ply or multi-ply arrangement of FIGS. 1–4, the preferred rollstock of microwave interactive material comprises an aluminum film vacuum deposited on Hoechst Celanese 2600 60 gauge polyester film, sufficient to give an optical density of 0.25±0.05 as measured by a Tobias densitometer. Such a material can be prepared by, and obtained from, Madico of Woburn, Mass. 01888.

For the one-ply arrangement of FIG. 7, the preferred rollstock of microwave interactive material comprises an aluminum film vacuum deposited on a Hoechst Celanese 2600 48 gauge polyester film, sufficient to give an optical density 0.25±0.05 as measured by a Tobias densitometer, with the plastic side laminated to a layer of paper, such as RHI-PEL 250, with WC3460ZZ. The metallized polyester can be obtained from Madico of Woburn, Mass. 01888. Usable laminate, with paper applied thereto, is available from Phoenix Packaging of Maple Grove, Minn.

For both the two-ply and one-ply arrangements, the preferable heat sealable adhesive usable to form the heat seal pattern is a polyvinyl acetate homopolymer adhesive such as Duracet 12 available from Franklin International, Inc. of Columbus, Ohio. The seals, when such materials are used, can be formed in a conventional manner using the heated jaws of a heat sealing apparatus.

In the two-ply construction of FIGS. 1–4, the preferred adhesive for securing the metal side of the microwave interactive construction to the immediately adjacent paper, is a conventional laminating adhesive used for microwave interactive constructions in packages. Preferred ones are ethylene vinyl acetate copolymer adhesives, for example Product No. WC-3460ZZ from H.B. Fuller Company of Vadnais Heights, Minn. A similar adhesive is preferred in the one-ply arrangement of FIG. 1, for securing the metal side of the microwave interactive construction to the paper.

In the two-ply arrangement of FIGS. 1–4, when the web used for the inner ply is a greaseproof paper, and not merely a kraft paper to be treated for greaseproof character by application of laminating adhesive thereto, the preferred web is a flexible paper material having a basis weight no greater than about 25 pounds per ream, preferably within the range of 21–25 pounds. In such instances, it is preferably an FC807 (fluorochemical) treated paper having a grease-resistant character under the Scotchban® test of minimum kit 8. A usable material is Rhinelander greaseproof RHI-PEL 250, available from Rhinelander Paper Company of Rhinelander, Wis. 54501. FC807 is a chemical treatment available from 3M Company, St. Paul, Minn. It is noted that in some instances a grease-resistant character to the inner paper may be desirable, in spite of the fact that what is of greater importance with respect to this paper is greaseproofness. A reason is that a grease staining of the surface of the inner sheet of paper may be viewed through the outer layer, and be unattractive to the customer. Thus, treatments of the inner layer, especially its outer surface, for grease resistance character (of preferably minimum kit 8 by the Scotchban® test) has in some instances been desirable, and is achievable with techniques according to the present invention.

In the one-ply arrangement of FIG. 7, when the web used for the inner ply is a greaseproof paper, not merely a kraft paper to be treated for greaseproof character by application of an adhesive according to the present invention thereto, the preferred web is a flexible paper material having a basis weight no greater than about 45 lb/ream (or about 73 gram/square meter) and generally about 25–40 lb/ream (about 57 gram/meter square) or less, more preferably about 35 lb/ream. The following commercially obtainable material can be used as a greaseproof web, when a previously chemically treated paper is chosen as the inner web: RHI-PEL 371, available from Rhinelander Paper Company of Rhinelander, Wis. 54501. This is a refined, chemically treated sheet made of 100% chemical softwood pulp. It has a basis weight of 35 lbs/ream. The chemical used for the treatment, to render a greaseproof character to the paper, is Scotchban™ FX-845. The chemical Scotchban™ FX-845 is commercially available from Minnesota Mining and Manufacturing Company of St. Paul, Minn. 55144-1000.

In the two-ply arrangement of FIGS. 1–4, when the material used to form the inner ply of the paper is chosen as a paper that is not highly refined or highly chemically treated for greaseproofness, prior to the laminating adhesive being applied thereto, preferably the paper is a kraft paper having a basis weight of no greater than about 25 lb/ream, generally about 21–25 lb/ream or less. It may have, when evaluated for pin hole testing at least 1 hole/inch$^2$ and in fact may be 8 holes/inch$^2$, up to about 250 holes/inch$^2$ or more. A usable commercially available example is EB Eddy Grade 5160. This is a 21-pound kraft paper.

When the material forming the inner ply is a material which has been treated for grease-resistant character, but does not have a grease-resistance of minimum kit 8 when measured by the Scotchban® test, a usable material is Thilmany 1002, an FC807 treated paper having a kit 4 fluorocarbon level.

The preferred material for use in forming the outer paper layer, in a multi-ply construction, is a bleached kraft paper, sufficiently refined (or machine glazed) for printing thereon. It is preferably not a material which has been chemically treated, prior to application of the laminating adhesive and/or outer coating according to the present invention thereto. Thus, it can be a kraft paper of 0 kit and even have pin holes of 1 to 250 holes/inch$^2$ or more. Preferred materials are 21–25 pound kraft machine glazed paper, such as EB Eddy Grade 5160.

The preferred laminating adhesive for use in multi-ply arrangements, other than between the metal and the paper to which it is in immediate contact, is an adhesive which will impart greaseproofness to the inner paper layer of the laminate in which it is applied, when tested according to the turpentine test in the manner provided herein.

The preferred adhesives for use in application to the outer web, to provide grease-resistant character thereto, is a material which, when tested according to the Scotchban® test in the manner provided herein, will impart a resistance of at least minimum kit 8.

Experimental

Techniques Utilized to Evaluate Paper and/or Laminates

In general, in the experiments reported herein, four techniques are utilized to characterize paper, laminates or constructions according to the present invention with respect to greaseproof and/or grease-resistant character. These techniques can be generally characterized as the following:

A. Porosity

In general, this test concerns a determination of the time needed to pass 100 cc of air through a one inch square area of paper (or laminate).

B. Turpentine Test

In general, this test relates to the time for a turpentine solution to penetrate or drain through the paper stock. This is a test of greaseproofness.

C. A Scotchban® Paper Protector Test

This is a test developed by 3M to evaluate the level of Scotchban® protector on treated papers (or laminates). It is a test of grease-resistance.

D. Pin Hole Test

This is an evaluation of the number of pin holes per square inch of paper base stock. It indicates how porous the material is to leakage of grease.

From evaluations of some or all of the four types considered above, one can determine relative performances of materials used for, or in, laminates. The procedures for the various tests are as follows:

A. Determination of Porosity of Paper or Rollstock

PURPOSE

To determine the porosity (air resistance) of test sample.

EQUIPMENT

Teledyne Gurley SPS Tester—Model 4190

X-Acto Knife

Cutting Template (4"×4")

PROCEDURE

A. To Operate Tester

1. Turn on the electric eye.
2. Zero counter.
3. Align the ⅞" silver area on the inner cylinder vertically with the electric eye (⅞" silver area measures 100 cc of air).
4. Make sure that the 2# weight is in place on the lever arm and that unit is level by observing the built in level in the base platform.

B. To Test For Porosity

1. From a piece of paper or rollstock sample, cut a sample of paper 4"×4" using the cutting template and the X-Acto knife.

2. Insert a single sample of the paper between the clamping plates and lower the 2# weight attached to the lever arm by turning the crank.
3. Grasp the flange at the top of the inner cylinder. Disengage the spring support from under the flange and lower the cylinder gently until it floats in the oil. Now allow it to settle under its own weight.
4. The timer will start automatically when the electric eye detects the lower edge of the silver area on the cylinder and will automatically stop when it detects the upper edge of the silver area. When the timer stops, record the elapsed time. Record time before moving cylinder back to starting position.

IMPORTANT

NEVER RAISE THE INNER CYLINDER WHILE THE SAMPLE IS CLAMPED BETWEEN THE ORIFICE PLATES—TO DO SO WILL SUCK OIL INTO THE AIR TUBE.

C. Proper Sequence For Removing Sample

1. Hold onto flange at top of inner cylinder.
2. Remove weight by turning crank, to move lever arm to its uppermost position.
3. Take sample out.
4. Slowly lift the inner cylinder and secure with spring support.
5. When finished using the SPS Tester, the inner cylinder should be left in the upper position and the electric eye should be turned off.

REPORT

Document the time for the sample, and report as seconds Gurley. Herein, higher figures (second Gurley) indicate lower porosity, since the time is an indication of how long it takes to pass a given quantity of air.

ACCURACY CHECK

The SPS Tester should be checked for accuracy periodically. Check unit by using the Porosity Test Plate. When set up for proper porosity measurement, 100 cc of air will pass through the hole in the plate in 18.8 seconds +/−5%. The range will be 17.9 seconds to 19.7 seconds. Test in the same manner as paper samples and use average time of both sides of plate.

B. Turoentine Test for Greaseproof Character of Paper

This technique is published by TAPPI (The Technical Association of the Pulp and Paper Industry or TAPPI Test Methods Vol. I) as Test T 454 om-89, incorporated herein by reference. The technique is generally as follows:

2. Apparatus 2.1 Tube, of any rigid material, 25 mm (1 in.) i.d. and at least 25 mm (1 in.) in height, the ends of which have been smoothed for holding sand.

2.2 Buret or automatic pipet, calibrated to deliver 1.1 mL of liquid (to deliver the turpentine).

2.3 Sand, Ottawa cement testing sand, screened to pass a No. 20 and be retained on a No. 30 sieve.

2.4 Paper, white coated and calendared sheets of book paper, 104 g/m$^2$ (70 lb 25×38–500) of convenient size.

2.5 Timing device, stopwatch or laboratory timer.

2.6 Watch class, 7.6 cm diameter.

2.7 Scoop, 5-g capacity; check a few weights on an analytical balance to assure the weights are 5.0±0.1 g and consistent.

3. Reagent

Turpentine, moisture-free and colored; to 100 mL of pure gum spirits turpentine, sp gr 0.860 to 0.875 at 16° C. (60° F.), add 5 g of anhydrous calcium chloride and 1.0 g of an oil-soluble red dye. Stopper the container, shake well, and let stand for at least 10 hr, shaking occasionally. Then filter through a dry filter paper at a temperature of approximately 21° C. (70° F.), and store in an airtight bottle.

4. Place each specimen on the lower half of a sheet of coated book paper resting on a smooth flat surface. Place an end of the tube on the specimen and put 5 g of sand in the tube. Because the purpose of the tube is solely to ensure a uniform area of the sand pile, remove it immediately after the addition of the sand by carefully lifting the tube straight up. Saturate the sand pile with 1.1 mL of colored turpentine using a buret or automatic pipet. The 1.1 mL of colored turpentine will saturate exactly 5 g of sand. Start the timing device. When more than one specimen is tested simultaneously, start the timing device immediately after the colored turpentine has been added to the first specimen. Add the turpentine to the remainder of the specimens. Since the test sequence begins at the moment of saturation and ends when staining is observed, the turpentine should be added to each specimen at equally incremental times (e.g. every 10 seconds) so that the end point for each specimen can be more easily determined. Move the specimens to unsoiled positions on the coated paper in the same time sequence used for turpentine addition. Examine the uncovered areas for staining. Record the elapsed time for each specimen, at the first sign of stain penetration.

NOTE: It is advisable to make a few preliminary tests if the approximate period is not known. Cover with a watch glass any specimens which require over 2 min to stain.

5. Report 5.1 Report the test result in seconds.

C. 3M Scotchban® Paper Protector Test

This test is generally published under the designation TAPPI UM557, incorporated herein by reference. The test is as follows:

APPARATUS

1. Test Bottles—3M (Minnesota Mining and Manufacturing Co., St. Paul, Minn.) provides a kit for conduct of the test; the kit includes, inter alia: small (50 ml) bottles for use during testing and equipped with droppers or rods for application of solutions to the sheet to be tested.
3. Absorbent Cotton or Tissue.
4. Stopwatch or Timer.

REAGENTS: (commercially available from 3M as part of the kit)

1. Castor Oil, C.P. Grade
2. Toluene, C.P. Grade
3. Heptane, C.P. Grade

| Kit Number | Volume Castor Oil ml. | Volume Toluene ml. | Volume Heptane ml. |
|---|---|---|---|
| 1 | 200 | 0 | 0 |
| 2 | 180 | 10 | 10 |
| 3 | 160 | 20 | 20 |
| 4 | 140 | 30 | 30 |
| 5 | 120 | 40 | 40 |
| 6 | 100 | 50 | 50 |
| 7 | 80 | 60 | 60 |
| 8 | 60 | 70 | 70 |
| 9 | 40 | 80 | 80 |
| 10 | 20 | 90 | 90 |
| 11 | 0 | 100 | 100 |
| 12 | 0 | 90 | 110 |

Prepare mixtures of these reagents according to the table above. Do not measure the reagents by addition since there will be loss of volume upon mixing. Store these in the labeled stock bottles. As required, fill each dropping bottle with the appropriate Kit Number reagents from the stock bottles.

TEST SPECIMENS

Obtain five representative specimens of suitable size (at least 2×2 inches or 5×5 cm).

PROCEDURE

Place each test specimen on a clean flat surface, test side up, being careful not to touch the area to be tested. Drop on the test area, from a height of about one inch (2.5 cm), a drop of test solution from an intermediate Kit Number testing bottle. Start a stopwatch as the drop is applied. After exactly 15 seconds, remove the excess fluid with a clean swatch of cotton or tissue and immediately examine the wetted area. Failure (i.e. staining or lack of grease resistance) is evidenced by a pronounced darkening of the specimen caused by penetration, even in a small area, under the drop. Repeat the procedure as required, making sure that drops from other Kit Number bottles fall in untouched areas.

REPORT

Report results as the Kit Rating, which is the highest numbered solution that stands on the surface of the specimen for 15 seconds without causing failure. Report the average Kit Rating of five specimens to the nearest whole number.

D. Paper Pin Hole Test

This test is conducted as follows:

PURPOSE

To determine the number of pin holes per square inch of paper base stock. The results will predict strike through performance when coating or laminating the stock.

EQUIPMENT

1. Draw down roller, 220 line anilox with 90 durometer rubber roller, 2¾" wide
2. Backing paper, heavy weight 20# ledger quadrille paper, 4 squares per inch, sheet size 8½"×11"
3. Cutting template or cutter to cut 4"×11" sample
4. Drafting tape
5. Ink, 485 red or equivalent
6. Stopwatch or other timing device

PROCEDURE

1. Tape backing paper, 8½"×11", to draw down board or other flat surface.
2. Tape test sample, 4"×11", over quadrille paper.
3. Spread 1 ml red ink on tape over test sample, 2¾" wide.
4. Draw down ink over the test sample with anilox roller, using moderate pressure.
5. After thirty (30) seconds, remove the test sample and view the backing sheet for bleed through.
6. Using the 2"×3½" template, measure an area seven (7) square inches by starting 1¼" to the right of sample edge and ¼" down from top of 4" sample. Count the dyed spots in the 7 square inch area.

CALCULATE

Total count divided by 7=pin holes per square inch.

REPORT

Pin hole count per square inch.

EXAMPLES

Greaseproof Barrier and Laminating Adhesive

A conventional microwave popcorn bag in commercial use by Golden Valley Microwave Foods, of Edina, Minn., the assignee of the present invention, is constructed of a lamination of a printed bleached (or natural) kraft paper, adhesive, thin film metallized susceptor, adhesive and a greaseproof bleached kraft paper.

The inner ply or the greaseproof bleached kraft paper provides the primary oil or grease barrier in this conventional package. The conventional greaseproof inner liner was evaluated for greaseproof and grease-resistant characteristics by the use of four standard tests: porosity, turpentine test, Scotchban® kit test and pin hole test. Other types of experimental tests may be used by paper companies to characterize "greaseproof" or grease-resistant paper properties, however the ones described herein are widely used and are sufficiently accurate and reproducible. In general, "Greaseproof" is used in the industry as a proper noun to identify a specific class of papers which are made from kraft process wood fiber, highly refined, hydrated and chemically treated to have greaseproof properties.

A. Porosity

The porosity of the grade of greaseproof inner liner used in the conventional microwave popcorn bag ranges from 1000 seconds Gurley to 4000 seconds Gurley. Porosity is measured with a densimeter called a Teledyne Gurley Model No. 4190. Other densimeters, such as the Teledyne Gurley Model No. 4200 can be used, but the results reported herein are from Model No. 4190. Porosity results are reported in seconds Gurley, which is the time required for 100 cubic centimeters of air to pass through a one square inch area of paper. A long time or high test indicates a slow passage of air and is characteristic of a well formed, dense sheet, while a short time or a low test indicates a rapid passage of air through the sheet. In certain applications of the present invention, where the primary greaseproof barrier is from the laminating adhesive layer of the structure and does not result from the paper alone, the inner ply sheets can be very porous and have porosities that are reflected by times of less than 1000 seconds Gurley, and even less than 500 seconds Gurley.

Examples

| Paper | Porosity |
|---|---|
| EB Eddy Grade 5160[1] | 164.4 seconds |
| EB Eddy Grade 5146[2] | 424.2 seconds |
| Thilmany Grade 1002[3] | 33.4 seconds |
| Thilmany Grade 1037[4] | 50.9 seconds |

[1]EB Eddy Grade 5160 is a high porosity, kit 8, machine grade kraft paper from EB Eddy Paper Co., Port Huron, MI.
[2]EB Eddy Grade 5146 is a high porosity, kit 0, machine grade kraft paper from EB Eddy Paper Co., Port Huron, MI.
[3]Thilmany Grade 1002 is a low porosity, kit 4, grease-resistant kraft paper from International Paper of Kaukauna, WI.
[4]Thilmany Grade 1037 is a low porosity, kit 8, grease-resistant kraft paper from International Paper of kaukauna, WI.

The results were obtained following the test procedure described above. Each sample is cut 4"×4", and is placed between the clamping plates. The weight is lowered and then the cylinder is lowered. The timer starts automatically when the electric eye detects the silver area on the cylinder and stops automatically when it detects the upper edge of the silver area on the cylinder. This silver area represents 100 cc of air.

B. Turpentine Test

Papers that are manufactured to resist the penetration of oil are tested with colored turpentine to report their "greaseproofness". The greaseproofness of the grade of inner liner used in a conventional microwave popcorn bag is specified at Golden Valley Microwave Foods at 180 minutes (3 hours), with a 100 minutes (1.67 hours) minimum. With the material that forms the inner liner of conventional arrangements, one often sees results that exceed 24 hours. The time between the start of the test and the first indication of staining is reported as the "greaseproofness" of the paper sheet. A long time or high test indicates a slow drainage rate through the sheet while a short time indicates a fast drainage rate through the sheet.

Examples

| Paper | Greaseproofness |
|---|---|
| EB Eddy Grade 5160 | 147 minutes |
| EB Eddy Grade 5146 | 1 second |
| Thilmany Grade 1002 | 1 second |
| Thilmany Grade 1037 | 45 minutes |

The results were obtained following the TAPPI test procedure described above with the results being from one sample and no pre-conditioning of the sheets. The sample to be evaluated is cut 4"×4" and is placed on the calendared sheet specified. The tube is used to ensure a uniform cone of silica sand. The tube is removed after the 5 grams of sand are added to it. The sand is saturated with 1.1 ml of colored turpentine. The timer is started immediately after the colored turpentine is added. The samples are carefully moved at timed intervals, such as every 10 to 15 seconds for the first three minutes of the test, then every 10 to 15 minutes for the next three hours of the test, and then every 60 minutes for the remainder of the test time. The time between the start of the test and the first indication of staining is reported as the "greaseproofnesse" of the paper sheet.

C. Kit Test

The kit rating (grease-resistance) of the grade of inner liner used in the conventional Golden Valley Microwave Foods microwave popcorn bag is specified at kit level 8, minimum. Results at kit 9 to kit 11 are common. The kit test measures the level of 3M Scotchban® Protector or FC807 present in the paper sheet. FC807 is an invisible grease and oil barrier with the primary purpose of preventing oil stain. It also provides a second level of protection from pin holes and inhibits wicking along cut edges, folds, score lines and seams.

Examples

| Paper | Grease-resistance |
|---|---|
| EB Eddy Grade 5160 | 8 kit |
| EB Eddy Grade 5146 | 0 kit |
| Thilmany Grade 1002 | 4 kit |
| Thilmany Grade 1037 | 8 kit |

3M Company provides a test kit package that includes level 3–12. Small (50 ml) test bottles at each level are included along with droppers for application of solution to the paper to be tested. The test procedure described above was followed. One drop of test solution is dropped from the height of one inch onto the test sample. A stopwatch is started as the drop is applied. After 15 seconds the drop is removed with a tissue and the wetted area is examined. Failure (i.e. staining) is evidenced by a darkened area under the drop. Kit level is reported as the highest numbered solution that stands on the surface of the sheet for 15 seconds without failing (staining).

D. Pin Hole Test

The pin hole count of the grade of greaseproof inner liner used in the conventional Golden Valley Microwave Foods microwave popcorn bag is 0–1 per square inch. Pin holes are straight through pores in the cellulose fibers of the paper sheets which are not visible to the naked eye. In conventional thinking, numerous pin holes are unacceptable since they detract from the sheet's ability to resist the penetration of oil. A high number of pin holes in conventional thinking indicates a poorly formed sheet while a low number of pin holes indicates a well formed dense sheet. For arrangements according to the present invention, the inner liner may even have numerous pin holes. The following tests indicate some examples.

Examples

| Paper | Pin Holes |
|---|---|
| EB Eddy Grade 5160 | 36/sq. in. |
| EB Eddy Grade 5146 | 8/sq. in. |
| Thilmany Grade 1002 | 210/sq. in. |
| Thilmany Grade 1037 | 215/sq. in. |

The results were obtained following the test procedure described above, which is basically a drawing of ink over the test paper (which is placed over quadrille paper). The rubber roller forces the ink through the pin holes in the sheet appearing on the quadrille paper. In a 7 square inch area, the ink spots are counted. The total count is divided by 7 to report the pin hole count per square inch.

E. Examples of Laminates Evaluated

The papers listed (EB Eddy Grade 5160; EB Eddy Grade 5146; Thilmany Grade 1002; and, Thilmany Grade 1037) were laminated with polyvinyl acetate adhesive (Duracet 12) on a press, or they were laminated with a greaseproof adhesive (National Starch 71-4253 or another example of a greaseproof adhesive) on a press. In each case the test samples were prepared as described in the section below concerning test laminates. The laminates were tested for porosity and turpentine greaseproofness by the methods previously described for the paper sheets. The laminates compared as follows:

| Sample | Paper | Porosity (Sec. Gurley) | Turpentine (Minutes) |
|---|---|---|---|
| | Polyvinyl Acetate Laminations | | |
| 1 | Thilmany Gr 1037/ Thilmany Gr 1037[1] | 688.2 sec | 120 min |
| 2 | Thilmany Gr 1002 | 703.9 sec | 8 min |
| | Thilmany Gr 1002[1] | 703.9 sec | 8 min |
| | Grease-Resistant Laminations | | |
| 3 | Thilmany Gr 1037/ Thilmany Gr 1037[2] | 18339.4 sec | 420 min |
| 4 | Thilmany Gr 1002/ Thilmany Gr 1002[2] | 76030.4 sec | 420 min |
| 5 | EB Eddy Gr 5160/ EB Eddy Gr 5146[2] | 1891.1 sec | 900 min |

[1]The two papers identified in each sample were laminated to one another with Duracet 12.
[2]The adhesive used in each case was NS #71-4253 as described below.

Thus, the laminates with Duracet 12 were relatively porous and were not greaseproof. Changing to an adhesive according to the present invention resulted in a non-porous, greaseproof laminate, even though porous, non-greaseproof papers were used.

For Sample 3, the outer sheet or Thilmany 1037 was overall coated with National Starch #71-4253. The NS

#71-4253 was diluted to 29 seconds on a #5 Zahn cup by adding approximately 0.5 gallons water to each 15 gallons commercial product, resulting in a dry lamination weight of 3–4 pounds/ream. The starch was applied using a gravure station. The outer ply was then laminated to the inner ply, which in this example is also a Thilmany 1037 sheet that previously had MPET (metallized polyester) cut 5.5" long by 5" wide laminated to it using 4–5 pound/ream (dry weight) Fuller WC3460ZZ (metal side to Fuller) as shown in FIG. 5 by Number 200. Again the production sequence continued as shown in FIG. 5 with heat seal coatings and ink. Sample 4 was produced similarly except the outer and inner sheets in this example were Thilmany Grade 1002.

Analysis

The samples suggest a wide variety of advantageous applications and improvements that can be made, applying the techniques of the present invention. Compare, for example, lamination Sample 2 to lamination Sample 4. Changing the laminating adhesive from conventional Duracet 12 to National Starch No. 71-4253 resulted in a substantial decrease in measured porosity and increase in greaseproofness. That is, the porosity test showed that a much longer time was needed to pass the air; and, the greaseproof test showed a much longer time for the turpentine to soak through the laminate.

Comparing lamination Sample 1 to lamination Sample 3, shows that even when a fluorochemically treated paper is utilized in a lamination, substantial improvement can occur when a conventional polyvinyl acetate material is replaced with a starch material according to the present invention.

Sample 4 was made with paper layers of minimum kit 4. Sample 5 shows that a greaseproof, nonporous lamination can even be made with a highly porous, non-fluorochemically treated, kraft paper. (EB Eddy Grade 5146 is a non-fluorochemically treated paper although EB Eddy 5160 is kit 8.)

The examples and tests provided suggest a wide variety of ways of defining constructions and methods according to the present invention.

F. Laboratory Test Coatings and Test Laminates

For evaluations according to the present invention, it may be necessary to prepare various test samples. In some instances, the test samples comprise simply a piece of paper. In others, they comprise a piece of paper with a coating applied thereto. In still others, they comprise a laminate of two sheets of paper, secured to one another by an adhesive. In this section, methods for preparing the various samples to be tested, and detailed recitations of certain calculations or measurements made on the samples, are provided. In each instance, the equipment used is readily and commercially available, and alternate equipment which performs similarly can be used.

Sample Preparation of Test Coatings

1. Paper Backing for Coatings
   a. One sheet of 23# E.B. Eddy Grade 5146; a high porosity, Kit 0, machine grade kraft paper from E.B. Eddy Paper Co.
   b. Samples cut 8½"×11" from Roll 1-B, Lot #64380 produced on No. 6 Paper Machine at the Port Huron mill.
   c. Test results of grease resistant characteristics:
      (a) Turpentine Test—1 second fail
      (b) Porosity—370.4 sec. Gurley
      (c) Kit Level—0
      (d) Pin Holes—42 per square inch.
2. Coating Preparation
   a. Each coating is mixed and diluted with water if necessary to provide an appropriate consistency for laboratory drawdowns.
   b. A sample of each coating material is analyzed for solids on a Computrac Max 50.
3. Drawdown Procedure A portion of the coating material to be applied is drawn down on the 23# E.B. Eddy Grade 5146 paper with an appropriate drawdown rod. Drawdown rods are available from CSD Tech International, Inc., Consler Scientific Design Division, P.O. Box 1669, Oldsmar, Fla. 34677. The selection of one of the drawdown rods is based upon the desired basis weight of the dry coating.

Steps (a) Tape one sheet of 8½"×11" of E.B. Eddy 23# paper on a drawdown plate with 3M Drafting Tape; Scotch 230 about 1" below top of paper.

(b) Place approximately 3 ml coating material evenly across tape.

(c) Drawdown with a #3 rod or a #5 rod using a steady, even stroke with steady downward pressure. The paper substrate should be coated in less than 2 seconds. It is important to spread the coating relatively evenly on the substrate material.

(d) Completed drawdowns are cured at 180° C. (356° F.) for 30 seconds in a forced air oven, Model DX-38. American Scientific Products of McGraw Park, Ill. 60085. Drawdowns are then hung vertically and allowed to air dry for 18–24 hours.

(e) The basis weight of each coating is obtained by comparison of the weight of a precisely cut portion of plain paper and paper containing the coating. The weight of the paper strip is subtracted from the weight of the coated strip. The coating weight in grams is then multiplied by the conversion factor for the given template size to obtain the coating weight in pounds per ream.

4. Results of Test Coatings

Samples for further testing are cut from the prepared drawdowns. Table I contains results of grease resistant characteristics of coatings tested.

TABLE I

Greaseproof and Grease Resistant Characteristics of Test Coatings*

| SAMPLE | & SOLIDS | BASIS WT #/RM | BASIS WT $g/m^2$ | TURPENTINE TEST TIME TO FAIL | KIT LEVEL 3M | PIN HOLES No/Sq In |
|---|---|---|---|---|---|---|
| Paper Only 1 Sheet | — | — | — | 1 second | 0 | 42.0 |
| NS 71-4253[1] | 33.5 | 4.90 | 7.97 | 320 minutes | 12+ | 0 |
| | | No fail at 12 | | | | |

TABLE I-continued

Greaseproof and Grease Resistant Characteristics of Test Coatings*

| SAMPLE | & SOLIDS | BASIS WT #/RM | BASIS WT g/m$^2$ | TURPENTINE TEST TIME TO FAIL | KIT LEVEL 3M | PIN HOLES No/Sq In |
|---|---|---|---|---|---|---|
| Fuller[1] WB9040 | 16.6 | 3.91 No fail at 12 | 6.36 | 26 minutes | 12+ | 0.1 |
| Franklin[1] TA-4-7 | 20.7 | 4.12 No fail at 12 | 6.71 | 88 minutes | 12+ | 0.6 |
| Duracet 12[1] (PVA) | 43.6 | 5.69 | 9.26 | 8 minutes | 6 | 2.9 |
| Ajax 493-1[1] (EVA) | 42.9 | 5.33 | 8.67 | 2 minutes | 6 | 0.7 |

[1]All coatings were put on 23# E.B. Eddy Grade 5146, Kit 0, single sheet.

Sample Preparation of Test Laminates

1. Paper for Lamination a. Two sheets; inner and outer, 23# E.B. Eddy Grade 5146; a high porosity Kit 0, machine grade kraft paper from E.B. Eddy Paper Co.

b. Samples cut 8½"×11" from Roll 1-B, Lot #64380 produced on No. 6 paper machine at the Port Huron mill.

c. Test results of grease resistant characteristics:

Turpentine Test (2 sheets)—1 second fail

Porosity (2 sheets)—704.1 second Gurley

Kit Level (2 sheets)—0

2. Laminating Adhesive Preparation a. Each laminating adhesive is mixed and diluted with water if necessary to provide an appropriate consistency for laboratory drawdowns.

b. A sample of each adhesive is analyzed for percent solids on the Computrac Max-50 per Test Procedure 0024.

3. Lamination Procedure

A portion of the laminating adhesive is applied by drawing it down on a 23# E.B. Eddy Grade 5146 sheet with an appropriate drawdown rod while simultaneously laminating the other sheet of 23# E.B. Eddy Grade 5146 by nipping it over the laminating adhesive with a #0 rod or a ¾" O.D. stainless steel rod. Again the selection of the drawdown rod used to evenly spread the adhesive is based on the desired basis weight of the dried lamination adhesive.

Steps (a) Tape one sheet of 8½"×11" of E. B. Eddy 23# paper on a drawdown plate with 3M Drafting Tape; Scotch 230 about 1" below top of paper.

(b) Tape another 8½"×11" E.B. Eddy 23# paper sheet on top of the first sheet with 3M Drafting Tape, Scotch 230 at the top of the second sheet.

(c) Place the #0 rod on the tape of the second sheet and fold the second sheet over the rod so the rod will put the second sheet over the first sheet.

(d) Place approximately 3 ml laminating adhesive evenly across tape securing the first sheet.

(e) Drawdown the laminating adhesive with a #3 rod or a #5 rod while simultaneously pulling the second paper sheet over the adhesive with the #0 rod. Again it is important to spread the laminating adhesive relatively evenly on the substrate material. The lamination should be completed in less than 2 seconds.

(f) Completed laminations are cured at 180° C. (356° F.) for 30 seconds in a forced air oven, Model DX-38 from American Scientific Products. Laminations are then hung vertically and allowed to air dry for 18–24 hours.

(g) The basis weight of the laminating adhesive is obtained by comparison of the weight of a precisely cut portions of each paper in the lamination to the weight of the total lamination. The weight of the paper strip is subtracted from the weight of the total lamination strip. The laminating adhesive weight is then multiplied by the conversion factor for the given template size to obtain the laminating adhesive weight in pounds per ream.

4. Results of Test Coatings

Samples for further testing are cut from the prepared test laminates. Table II contains results of grease resistant characteristics of laminates tested.

TABLE II

Greaseproof and Grease Resistant Characteristics of Test Laminates*

| SAMPLE | & SOLIDS | BASIS WT #/RM | BASIS WT g/m$^2$ | TURPENTINE TEST TIME TO FAIL | KIT LEVEL 3M |
|---|---|---|---|---|---|
| Paper Only 1 Sheet | — | — | — | 1 second | 0 |
| NS 71-4253[1] | 36.9 | 5.97 | 9.72 | 24 hours + (No fail after 24 hours) | 0 |
| Fuller WB9040[1] | 16.6 | 3.91 | 6.36 | 150 minutes | 0 |
| Franklin TA-4-7[1] | 20.7 | 4.19 | 6.82 | 24 hours + (No fail after 24 hours) | 0 |
| Duracet 12 (PVA)[1] | 43.6 | 4.12 | 6.71 | 3 minutes | 0 |
| Ajax 493-1 (EVA)[1] | 42.9 | 4.48 | 7.29 | 20 seconds | 0 |

[1]All laminates were made with two sheets 23# E.B. Eddy Grade 5146, Kit 0.

Basis Weight of Lamination Adhesive

PURPOSE

To determine the amount of lamination adhesive on rollstock.

EQUIPMENT

Gravity Drying Oven (American DX-38)

Analytical Balance (Sartorius 1801-MP8)

Punch Press NAEF

TM Cutting Die (9/16"×2⅜")

PROCEDURE

1. Align rollstock in punch press to cut a 9/16"×2⅜" area. The area should not include additional heat seal coating or MPET. Downstroke handle of punch press to cut sample, upstroke handle to expel sample.

2. Remove sample from cutting table with tweezers and place in drying clip (Binder Clip BC-50 from Office Int'l Corp.)

3. Align inner greaseproof sheet from jumbo roll in punch press to cut a 9/16"×2⅜" area. Remove sample as in #2.

4. Repeat above procedure for outer kraft sheet from jumbo roll.

5. Place samples in single layer in the gravity oven at 105° C.±3° C. for 10 minutes.

6. Remove samples and place them in a Ziplock® bag to prevent moisture pick-up from the air.

7. Remove samples from drying clip with tweezers and weigh on Sartorius as rapidly as possible. Record weight to 4 decimal places.

CALCULATIONS

1. Subtract the weight of each paper sheet from the weight of the rollstock strip. This is the weight of the adhesive in grams.

2. The adhesive weight in grams is then multiplied by the conversion factor 710.76. The result is the basis weight of adhesive in lbs/ream.

Dry rollstock sample wt. (g)−Dry greaseproof sample wt. (g)−Dry kraft sample wt. (g)×conversion factor=Basis weight of adhesive (lbs/ream).

REPORT

Calculated basis weight of lamination adhesive.

Test Procedure for Determining Solids Content of Adhesive or Other Coating Materials

PURPOSE

To determine content of adhesive or other coating materials.

EQUIPMENT

Computrac Max-50

Flat Bottom Sample Pan

Filter Paper

PROCEDURE

1. Turn Max-50 on and let it warm up for 20 minutes.

2. Press RESET button.

3. Press HI TEMP SP to display the currently programmed initial temperature. It should read 160; if not, use the "up" or "down" arrow keys while simultaneously pressing the HI TEMP SP key to adjust temperature.

4. Press TEMP SP to display the testing temperature. It should read 140; if not use the "up" or "down" arrows to adjust while simultaneously pressing the TEMP SP key.

5. Place a clean, uniform flat-bottomed sample pan and one piece of dried filter paper onto the sample pan support in the test chamber. (Dry 10 pieces of filter paper at one time per TP Number 0024 on the Max-50, Temp SP 150 and store in a Ziplock® bag until used.) Close the chamber lid. Press TEMP button to read present chamber temperature. Chamber temperature must be 35°–40° or lower before continuing test.

6. Press the START key to begin the test in the 97 program.

7. Max-50 will display oo and then LOAD light will come on.

8. Open the chamber lid. Using a 10 ml syringe, spiral adhesive or other coating material until 30% sample weight is reached; note actual number. The Max-50 will beep at 30% sample weight. The CLOSE light will come on. Liquid samples should always be mixed or shaken to ensure a homogeneous mixture before sampling.

9. Remove sample from test chamber and place on a level surface. Grasp a portion of the filter paper and flip it over so the sample is between the pan and the paper. Squash the sample with the flat bottom of a 500 ml beaker to obtain a uniform layer. Return the sample pan to the test chamber and close the lid so the test will continue.

10. Make certain sample weight numbers read the same as before the sample was removed from scale pan (i.e. 30 before step 9, 30 after step 9).

11. During the test, the display will show the currently calculated percent moisture. Pressing the TIME key will display the elapsed test time. PREDICT will display the current predicted ending result. This reading is an approximation only. (100%−% Moisture=% Solids).

12. When the test is completed, the Max-50 will beep three times; the % MOIS and FINAL lights will come on. Press a SOLIDS to display that value. The CHECK lamp will also light as a reminder to remove the sample from the chamber.

13. Leave lid open on test chamber to aid cooling. Remember, the next test cannot be started until chamber has cooled to 35°–40° or lower.

14. To abort a test or to erase and recheck a system failure, press the RESET button.

CALCULATION

None

REPORT

% Solids

G. Summary of Tests

In the section entitled "F. Laboratory Test Coatings and Test Laminants," a series of experiments relating to sample preparation and testing were provided. In general, the particular experiments provided concern the utilization of 23# EB Eddy Grade 5146 paper, high porosity, kit 0, machine grade kraft paper from EB Eddy Paper Company. When testing for evaluation is to be made on an alternative paper, analogous techniques to those described in this section may be used.

In the claims, some subject matter may be defined with respect to choice of an adhesive which, if it were applied in a test lamination as laminating adhesive between two plys of non-greaseproof paper, provides the test lamination with some defined greaseproofness or similar characteristic. A paper which is suitable for conduct of such a test, is 23# EB Eddy Grade 5146 or a similar paper, as defined in Section F, above.

In other instances, the claim and subject matter may be defined with respect to use of an adhesive which provides certain characteristics as a laminating adhesive between two plys of paper which correspond to the paper used in the actual construction. When an evaluation of such subject matter is called for, tests analogous to those described in Section F, above, wherein 23# EB Eddy Grade 5146 was used, would be appropriate, with substitution of the appropriate paper(s) to be evaluated.

Similar reasoning applies with respect to evaluations of other characteristics such as grease resistance and porosity.

In the examples of Section F, analyses of coatings applied to single sheets are also provided. Again, the techniques may be utilized to evaluate coating single sheet test samples of other papers, by substitution of the appropriate paper into the technique described.

What is claimed is:

1. A microwave popcorn package comprising:

(a) a flexible, greaseproof two-ply bag construction comprising inner and outer plies of paper;

(i) said inner ply having an outer surface and being formed from a sheet of flexible paper material which, if evaluated before being incorporated in the bag construction, would have a greaseproofness of less than about 3 hours, when measured by the turpentine test, said inner ply not being glassene paper;

(ii) said outer ply having an inner surface and being formed from a sheet of flexible paper material which, if evaluated before being incorporated in the bag construction, would have a greaseproofness of less than about 3 hours, when measured by the turpentine test; and (b) a charge of popcorn and oil/fat positioned within said inner ply.

2. A package according to claim 1 wherein:

(a) said inner ply is formed from a sheet of paper material having a greaseproofness of less than 1 minute.

3. A microwave popcorn package according to claim 1 wherein:

(a) said inner ply comprises a paper which, if evaluated before being incorporated in the bag construction, would have a porosity value, in Gurley seconds, of lower than 500 Gurley sec.

4. A microwave popcorn package according to claim 1 wherein:

(a) said inner ply comprises a non-fluorochemically treated kraft paper.

5. A microwave popcorn package according to claim 4 wherein:

(a) said inner ply comprises a paper which, if evaluated before incorporated into the bag construction, would have a pin hole porosity of at least 8 holes/inch$^2$.

6. A microwave popcorn package according to claim 1 wherein:

(a) said outer ply is formed from a non-fluorochemically treated, machine glazed, paper having an outer surface.

7. A microwave popcorn package according to claim 6 including:

(a) a layer of adhesive material applied to an outer surface of said outer ply in sufficient amount to provide said outer ply with an increased grease resistance.

8. A microwave popcorn package according to claim 1 including:

(a) a microwave interactive construction positioned between said inner and outer plies of paper.

9. A microwave popcorn package according to claim 8 wherein:

(a) said microwave interactive construction comprises a metallized polyester film.

10. A microwave popcorn package according to claim 9 wherein:

(a) said metallized polyester film includes a metal film on only one side thereof; and (b) said microwave interactive construction is oriented in said package with said metal film directed toward said inner ply.

* * * * *

UNITED STATES PATENT AND TRADEMARK OFFICE
CERTIFICATE OF CORRECTION

PATENT NO. : 5,994,685

DATED : NOVEMBER 30, 1999

INVENTOR(S) : JACKSON ET AL.

It is certified that error appears in the above-identified patent and that said Letters Patent is hereby corrected as shown below:

Col. 1, line 3: insert --Cross Reference to Related Applications--

Col. 16, line 24: "4G" should read --46--

Col. 28, line 49: delete "703.9 sec 8 min"

Col. 30, line 63: move "No fail at 12" under column "KIT LEVEL 3M"

Col. 32, line 7: move "No fail at 12" under column "KIT LEVEL 3M"

Col. 32, line 9: move "No fail at 12" under column "KIT LEVEL 3M"

Signed and Sealed this

Twenty-second Day of May, 2001

*Attest:*

Nicholas P. Godici

NICHOLAS P. GODICI

*Attesting Officer*

*Acting Director of the United States Patent and Trademark Office*